US008691360B2

(12) United States Patent
Pacione

(10) Patent No.: US 8,691,360 B2
(45) Date of Patent: Apr. 8, 2014

(54) STRUCTURES FOR CREATING SPACES WHILE INSTALLING ANCHOR SHEET AND ATTACHMENT PIECE SUBFLOORS

(75) Inventor: Joseph Rocco Pacione, Newmarket (CA)

(73) Assignee: Tac-Fast Georgia L.L.C., Atlanta, GA (US)

( * ) Notice: Subject to any disclaimer, the term of this patent is extended or adjusted under 35 U.S.C. 154(b) by 0 days.

(21) Appl. No.: 12/173,782

(22) Filed: Jul. 15, 2008

(65) Prior Publication Data

US 2009/0031657 A1 Feb. 5, 2009

Related U.S. Application Data

(63) Continuation of application No. 10/013,688, filed on Dec. 13, 2001, now Pat. No. 7,412,806.

(51) Int. Cl.
*B32B 3/06* (2006.01)

(52) U.S. Cl.
USPC ..... 428/100; 52/403.1; 52/DIG. 13

(58) Field of Classification Search
USPC ..... 52/DIG. 13, 506.05, 509, 512, 403.1, 52/511, 698, 745.06, 746.12, 747.11; 428/100, 86, 95
See application file for complete search history.

(56) References Cited

U.S. PATENT DOCUMENTS

| | | | | |
|---|---|---|---|---|
| 644,138 | A | 2/1900 | Ketchum | |
| 652,716 | A | 6/1900 | Furness | |
| 748,746 | A | 1/1904 | Kelsey | |
| 1,187,103 | A | 6/1916 | Sagebrecht | |
| 1,673,630 | A | 6/1928 | Madge | |
| 1,929,871 | A | 10/1933 | Jones | |
| 2,012,929 | A | 8/1935 | Knowland | |
| 2,114,450 | A | 4/1938 | Maclean | |
| 2,735,523 | A | 2/1956 | Leyerle et al. | |
| 3,002,868 | A | 10/1961 | Brown | |
| 3,031,730 | A | 5/1962 | Morin | |
| 3,247,638 | A | 4/1966 | Gay, Jr. | |
| 3,522,637 | A | 8/1970 | Brumluk | |
| 3,574,019 | A | 4/1971 | Girard | |
| 3,583,057 | A | 6/1971 | Kolozsuary | |
| 3,657,852 | A | 4/1972 | Worthington et al. | |
| 3,708,833 | A * | 1/1973 | Ribich et al. | 24/450 |

(Continued)

FOREIGN PATENT DOCUMENTS

| | | |
|---|---|---|
| AU | 40926/72 | 10/1973 |
| BE | 853033 | 7/1977 |

(Continued)

OTHER PUBLICATIONS

InterfaceFLOR, Spring Catalog, 2006, pp. 1-56, Canada.

(Continued)

*Primary Examiner* — Chi Q Nguyen
(74) *Attorney, Agent, or Firm* — Christopher N. Hunter; Brian W. Gray; Norton Rose Fulbright

(57) ABSTRACT

Structures are described that create spaces while installing anchor sheet and attachment piece subfloors, but which allow for the expansion and contraction of anchor sheets after installation. The structures may be used on either the attachment pieces, anchor sheets or both. In one embodiment, the structure is a deformable margin; in another embodiment, the structure is a pull-away strip.

15 Claims, 17 Drawing Sheets

(56) References Cited

U.S. PATENT DOCUMENTS

| | | | | | |
|---|---|---|---|---|---|
| 3,711,349 | A | | 1/1973 | Snyder et al. | |
| 3,712,845 | A | | 1/1973 | Hartung | |
| 3,735,988 | A | | 5/1973 | Palmer et al. | |
| 3,775,856 | A | | 12/1973 | Schmidt | |
| 3,817,015 | A | | 6/1974 | Frangos | |
| 3,866,267 | A | | 2/1975 | Poletti | |
| 3,916,703 | A | | 11/1975 | Ribich et al. | |
| 4,035,874 | A | | 7/1977 | Liljendahl | |
| 4,216,257 | A | * | 8/1980 | Schams et al. | 428/93 |
| 4,405,668 | A | | 9/1983 | Wald | |
| 4,430,837 | A | | 2/1984 | Kirschenbaum | |
| 4,489,115 | A | | 12/1984 | Layman et al. | |
| 4,528,783 | A | | 7/1985 | Muir | |
| 4,557,448 | A | | 12/1985 | Brown et al. | |
| 4,557,774 | A | | 12/1985 | Hoopengardner | |
| 4,578,910 | A | | 4/1986 | Germeroth et al. | |
| 4,638,618 | A | | 1/1987 | Iesaka et al. | |
| 4,649,069 | A | | 3/1987 | Tone | |
| 4,671,976 | A | | 6/1987 | Vidal | |
| 4,673,603 | A | | 6/1987 | Roth | |
| 4,697,294 | A | | 10/1987 | Schafer | |
| 4,755,401 | A | | 7/1988 | Friedrich et al. | |
| 4,758,457 | A | | 7/1988 | Altus | |
| 4,766,022 | A | | 8/1988 | Tone | |
| 4,769,895 | A | | 9/1988 | Parkins | |
| 4,770,917 | A | | 9/1988 | Tochacek et al. | |
| 4,797,170 | A | | 1/1989 | Hoopengardner | |
| 4,809,375 | A | * | 3/1989 | Bull | 5/722 |
| 4,810,546 | A | | 3/1989 | McLaughlin | |
| 4,822,658 | A | | 4/1989 | Pacione | |
| 4,824,498 | A | | 4/1989 | Goodwin et al. | |
| 4,825,477 | A | | 5/1989 | Aranda | |
| 4,829,627 | A | | 5/1989 | Altus et al. | |
| 4,842,916 | A | * | 6/1989 | Ogawa et al. | 428/100 |
| 4,852,210 | A | * | 8/1989 | Krajicek | 15/228 |
| 4,870,725 | A | | 10/1989 | Dubowik | |
| 4,898,417 | A | | 2/1990 | Kudo | |
| 4,921,742 | A | | 5/1990 | Altus | |
| 4,922,670 | A | | 5/1990 | Naka et al. | |
| 4,968,548 | A | | 11/1990 | Gibson et al. | |
| 4,974,384 | A | | 12/1990 | Pacione | |
| 5,042,221 | A | | 8/1991 | Pacione | |
| 5,045,389 | A | | 9/1991 | Campagna | |
| 5,060,443 | A | | 10/1991 | Pacione | |
| 5,116,439 | A | | 5/1992 | Raus | |
| 5,133,166 | A | | 7/1992 | Pacione | |
| 5,135,195 | A | | 8/1992 | Dane | |
| 5,144,786 | A | | 9/1992 | Pacione | |
| 5,149,573 | A | | 9/1992 | Kobe et al. | |
| 5,191,692 | A | | 3/1993 | Pacione | |
| 5,200,245 | A | * | 4/1993 | Brodrick, Jr. | 428/100 |
| 5,259,163 | A | * | 11/1993 | Pacione | 52/511 |
| 5,333,423 | A | | 8/1994 | Propst | |
| 5,382,462 | A | | 1/1995 | Pacione | |
| 5,386,670 | A | | 2/1995 | Takeda et al. | |
| 5,398,347 | A | | 3/1995 | Luedtke et al. | |
| 5,479,755 | A | | 1/1996 | Pacione | |
| 5,482,755 | A | | 1/1996 | Manning | |
| 5,529,825 | A | | 6/1996 | Sutherland | |
| 5,537,793 | A | | 7/1996 | Murasaki | |
| 5,654,066 | A | | 8/1997 | Pacione | |
| 5,671,511 | A | * | 9/1997 | Hattori et al. | 24/444 |
| 5,672,404 | A | * | 9/1997 | Callahan et al. | 428/100 |
| 5,691,021 | A | * | 11/1997 | Kobe | 428/40.1 |
| 5,691,026 | A | | 11/1997 | Zinke et al. | |
| 5,691,027 | A | * | 11/1997 | Eckhardt et al. | 428/100 |
| 5,693,171 | A | | 12/1997 | Foster | |
| 5,723,195 | A | | 3/1998 | Pacione | |
| 5,753,336 | A | | 5/1998 | Stull | |
| 5,786,061 | A | * | 7/1998 | Banfield | 428/100 |
| 5,804,273 | A | * | 9/1998 | Drake et al. | 428/86 |
| 5,832,619 | A | | 11/1998 | Volkema, Jr. | |
| 5,863,637 | A | | 1/1999 | Månsson et al. | |
| 5,879,777 | A | * | 3/1999 | Shipley | 428/100 |
| 5,902,663 | A | | 5/1999 | Justesen et al. | |
| 5,965,232 | A | | 10/1999 | Vinod | |
| 5,980,230 | A | | 11/1999 | Dowd et al. | |
| 6,083,596 | A | | 7/2000 | Pacione | |
| 6,158,185 | A | | 12/2000 | Counihan | |
| 6,182,414 | B1 | | 2/2001 | Huang | |
| 6,199,328 | B1 | | 3/2001 | McGrath et al. | |
| 6,203,881 | B1 | | 3/2001 | Higgins | |
| 6,217,974 | B1 | | 4/2001 | Pacione | |
| 6,250,001 | B1 | | 6/2001 | Gillespie | |
| 6,298,624 | B1 | | 10/2001 | Pacione | |
| 6,306,477 | B1 | | 10/2001 | Pacione | |
| 6,395,362 | B1 | | 5/2002 | Pacione | |
| 6,406,194 | B1 | | 6/2002 | Neale, III et al. | |
| 6,460,303 | B1 | | 10/2002 | Pacione | |
| 6,471,976 | B1 | | 10/2002 | Taylor et al. | |
| 6,526,704 | B1 | | 3/2003 | Berard et al. | |
| 6,586,066 | B1 | | 7/2003 | Buckwalter et al. | |
| 6,599,599 | B1 | | 7/2003 | Buckwater et al. | |
| 6,673,177 | B2 | | 1/2004 | Buckwater et al. | |
| 6,797,353 | B1 | | 9/2004 | Pacione | |
| 6,802,167 | B2 | | 10/2004 | Pacione | |
| 7,096,632 | B2 | * | 8/2006 | Pacione | 52/506.05 |
| 7,383,663 | B2 | * | 6/2008 | Pacione | 52/120 |
| 2002/0124515 | A1 | | 9/2002 | Pacione | |
| 2003/0044569 | A1 | * | 3/2003 | Kacher et al. | 428/100 |
| 2003/0110720 | A1 | | 6/2003 | Berard et al. | |
| 2003/0110728 | A1 | | 6/2003 | Pacione | |

FOREIGN PATENT DOCUMENTS

| | | | |
|---|---|---|---|
| CN | 2381232 | | 6/2000 |
| CN | 1297338 | | 5/2001 |
| CN | 1371253 | | 9/2002 |
| DE | 7029524 | | 11/1970 |
| DE | 2012523 | | 2/1972 |
| DE | 2201231 | | 7/1973 |
| DE | 2245915 | | 4/1974 |
| DE | 2803006 | | 8/1979 |
| DE | 4228597 | | 3/1994 |
| DE | 19532685 | | 3/1997 |
| DE | 19724698 | | 12/1998 |
| EP | 0161637 | | 11/1985 |
| EP | 0321978 | | 6/1989 |
| EP | 0325473 | | 7/1989 |
| EP | 0455926 | | 11/1991 |
| EP | 0860543 | | 8/1998 |
| FR | 2328432 | | 5/1977 |
| FR | 2362257 | | 3/1978 |
| FR | 2582210 | | 11/1986 |
| FR | 2747605 | | 10/1997 |
| GB | 1204886 | | 9/1970 |
| GB | 1376262 | | 12/1974 |
| GB | 1546901 | | 5/1979 |
| JP | 48-112114 | | 12/1973 |
| JP | 5374719 | | 7/1978 |
| JP | 56-27210 | | 3/1981 |
| JP | 5981479 | | 6/1984 |
| JP | 61-62135 | | 4/1986 |
| JP | 61-187582 | U | 11/1986 |
| JP | 2-32151 | Y | 8/1990 |
| JP | 10-118988 | | 5/1998 |
| JP | 2002-105874 | | 4/2002 |
| JP | 2003-501569 | | 1/2003 |
| WO | 86/01247 | | 2/1986 |
| WO | 95/03723 | | 2/1995 |
| WO | 95/19242 | A1 | 7/1995 |
| WO | 95/32654 | | 12/1995 |
| WO | 96/41913 | | 12/1996 |
| WO | 98/03104 | | 1/1998 |
| WO | 98/30381 | A1 | 7/1998 |
| WO | 99/35943 | | 7/1999 |
| WO | 99/35944 | | 7/1999 |
| WO | 99/35945 | | 7/1999 |

(56) References Cited

FOREIGN PATENT DOCUMENTS

| | | |
|---|---|---|
| WO | 00/60974 A1 | 10/2000 |
| WO | 00/74544 | 12/2000 |
| WO | 01/81771 | 11/2001 |

OTHER PUBLICATIONS

Shikishima Boseki KK; Patent Abstracts of Japan JP2088015, Mar. 28, 1990.
United States Patent and Trademark Office, Office Action Dated Aug. 15, 2003, issued in U.S. Appl. No. 10/013,688.
Blake, Cassels & Graydon LLP, Response to Office Action Dated Jan. 15, 2004, submitted in U.S. Appl. No. 10/013,688.
United States Patent and Trademark Office, Office Action Dated May 17, 2004, issued in U.S. Appl. No. 10/013,688.
McCarthy Tetrault LLP, Response to Office Action Dated Nov. 17, 2004, submitted in U.S. Appl. No. 10/013,688.
United States Patent and Trademark Office, Office Action Dated Mar. 7, 2005, issued in U.S. Appl. No. 10/013,688.
McCarthy Tetrault LLP, Response to Office Action Dated May 26, 2005, submitted in U.S. Appl. No. 10/013,688.
United States Patent and Trademark Office, Office Action Dated Oct. 17, 2005, issued in U.S. Appl. No. 10/013,688.
McCarthy TetraultLLP, Response to Office Action Dated Feb. 17, 2006, submitted in U.S. Appl. No. 10/013,688.
United States Patent and Trademark Office, Office Action Dated May 10, 2006, issued in U.S. Appl. No. 10/013,688.
McCarthy Tetrault LLP, Response to Office Action Dated May 24, 2006, submitted in U.S. Appl. No. 10/013,688.
United States Patent and Trademark Office, Office Action Dated Sep. 12, 2006, issued in U.S. Appl. No. 10/013,688.
McCarthy Tetrault LLP, Response to Office Action Dated Feb. 12, 2007, submitted in U.S. Appl. No. 10/013,688.
United States Patent and Trademark Office, Office Action Dated May 14, 2007, issued in U.S. Appl. No. 10/013,688.
McCarthy Tetrault LLP, Response to Office Action Dated Aug. 14, 2007, submitted in U.S. Appl. No. 10/013,688.
United States Patent and Trademark Office, Office Action Dated Nov. 16, 2007, issued in U.S. Appl. No. 10/013,688.
Ogilvy Renault LLP, Response to Office Action Dated Feb. 28, 2008, submitted in U.S. Appl. No. 10/013,688.
United States Patent and Trademark Office, Office Action Dated Nov. 18, 2008, issued in U.S. Appl. No. 10/543,902.
Ogilvy Renault LLP, Response to Office Action Dated May 18, 2009, submitted in U.S. Appl. No. 10/543,902.
United States Patent and Trademark Office, Interview Summary Dated Jun. 26, 2009, issued in U.S. Appl. No. 10/543,902.
Ogilvy Renault LLP, Statement of the Substance of the Interview Dated Jul. 27, 2009, submitted in U.S. Appl. No. 10/543,902.
United States Patent and Trademark Office, Office Action Dated Aug. 14, 2009, issued in U.S. Appl. No. 10/543,902.
Ogilvy Renault LLP, Response to Office Action Dated Feb. 5, 2010, submitted in U.S. Appl. No. 10/543,902.
United States Patent and Trademark Office, Office Action Dated May 18, 2010, issued in U.S. Appl. No. 10/543,902.
Ogilvy Renault LLP, Response to Office Action Dated Jul. 16, 2010, submitted in U.S. Appl. No. 10/543,902.
United States Patent and Trademark Office, Office Action Dated Oct. 5, 2010, issued in U.S. Appl. No. 10/543,902.
Ogilvy Renault LLP, Response to Office Action Dated Apr. 4, 2011, submitted in U.S. Appl. No. 10/543,902.
United States Patent and Trademark Office, Office Action Dated Jun. 24, 2011, issued in U.S. Appl. No. 10/543,902.
Norton Rose or LLP, Response to Office Action Dated Dec. 23, 2011, submitted in U.S. Appl. No. 10/543,902.
United States Patent and Trademark Office, Office Action Dated Jan. 31, 2012, issued in U.S. Appl. No. 10/543,902.
Norton Rose Canada LLP, Response to Office Action Dated Jul. 31, 2012, submitted in U.S. Appl. No. 10/543,902.
United States Patent and Trademark Office, Office Action Dated Sep. 7, 2012, issued in U.S. Appl. No. 10/543,902.
Norton Rose Canada LLP, Response to Office Action Dated Mar. 7, 2013, submitted in U.S. Appl. No. 10/543,902.
United States Patent and Trademark Office, Office Action Dated May 7, 2013, issued in U.S. Appl. No. 10/543,902.
Tokyo Ink KK; Patent Abstracts of Japan JP57011279, Jan. 20, 1982.
Chinese Patent Office, Office Action Dated Apr. 18, 2008, issued in Chinese Patent Application No. 200480009074.6 (and translation).
China Patent Agent (H.K.) Limited, Response to Office Action Dated Sep. 2, 2008, submitted in Chinese Patent Application No. 200480009074.6.
Chinese Patent Office, Office Action Dated Dec. 19, 2008, issued in Chinese Patent Application No. 200480009074.6 (and translation).
China Patent Agent (H.K.) Limited, Response to Office Action Dated Apr. 30, 2009, submitted in Chinese Patent Application No. 200480009074.6.
Chinese Patent Office, Office Action Dated Mar. 2, 2010, issued in Chinese Patent Application No. 200480009074.6 (and translation).
China Patent Agent (H.K.) Limited, Response to Office Action Dated Jul. 19, 2010, submitted in Chinese Patent Application No. 200480009074.6.
Chinese Patent Office, Office Action Dated Feb. 9, 2011, issued in Chinese Patent Application No. 200480009074.6.
China Patent Agent (H.K.) Limited, Response to Office Action Dated Apr. 22, 2011, submitted in Chinese Patent Application No. 200480009074.6.
World Intellectual Property Office, International Search Report Dated Aug. 9, 2004, issued in PCT Application No. PCT/CA2004/000117.
European Patent Office, Office Communication Dated Nov. 30, 2005, issued in European Application No. 04 706 103.1-2313.
Vossius & Partner, Response to Office Communication Dated Jan. 10, 2006, submitted in European Application No. 04 706 103.1-2313.
European Patent Office, Office Communication Dated Feb. 17, 2006, issued in European Application No. 04 706 103.1-2313.
Vossius & Partner, Response to Office Communication Dated Aug. 28, 2006, submitted in European Application No. 04 706 103.1-2313.
European Patent Office, Office Communication Dated Sep. 18, 2006, issued in European Application No. 04 706 103.1-2313.
Vossius & Partner, Response to Office Communication Dated Mar. 27, 2007, submitted in European Application No. 04 706 103.1-2313.
European Patent Office, Office Communication Dated Nov. 14, 2007, issued in European Application No. 04 706 103.1-2313.
Vossius & Partner, Response to Office Communication Dated May 23, 2008, submitted in European Application No. 04 706 103.1-2313.
European Patent Office, Office Communication Dated Jun. 24, 2009, issued in European Application No. 04 706 103.1-2313.
Vossius & Partner, Response to Office Communication Dated Jan. 4, 2010, submitted in European Application No. 04 706 103.1-2313.

* cited by examiner

STRUCTURES FOR CREATING SPACES WHILE INSTALLING ANCHOR SHEET AND ATTACHMENT PIECE SUBFLOORS

RELATED APPLICATIONS

This application is a continuation of U.S. patent application Ser. No. 10/013,688 filed Dec. 13, 2001 which issued as U.S. Pat. No. 7,412,806 on Aug. 19, 2008, which is incorporated herein by reference for all purposes.

FIELD OF THE INVENTION

Structures to allow spaces of appropriate size to be created between adjacent anchor sheets and attachment pieces when installing the anchor sheets and attachment pieces to form a subfloor.

BACKGROUND OF THE INVENTION

Several earlier patent applications filed by the same inventor disclose an anchor sheet which can be supplied as a small or large module, with or without a pre-attached decorative covering, including the current inventor's U.S. application Ser. No. 08/850,726 filed May 2, 1997, Ser. No. 09/008,565 filed Jan. 16, 1998 and Ser. No. 09/008,584 filed Jan. 16, 1998. These earlier cases also disclose the anchor sheet as a modular unit which can form a contiguous mass of anchor sheet to be used as a subfloor to which a decorative covering is to be attached or as a finished floor when presupplied with a decorative surface. Such a contiguous mass can be formed by attaching the anchor sheets together by some form of overlap or by abutting the anchor sheets to each other and using an overlap of decorative covering or tape. Such mass can be free floating or attached to the floor.

SUMMARY OF THE INVENTION

The current invention relates to spacing structures for use with anchor sheets and attachment pieces which when abutted or overlapped can form a subfloor for detachable attachment of overlying decorative coverings. The attachment pieces (also called attachment devices or corner pieces) are shaped to fit into countersunk passageways formed through the anchor sheets when laid to cover a floor. If the attachment pieces are attached to the floor, the attachment pieces will hold down surrounding anchor sheets without attachment to the anchor sheets themselves.

One aspect of the invention is a structure on the attachment pieces which can be a deformable margin extending horizontally from the attachment pieces or anchor sheets. This deformable margin creates a suitable spacing between anchor sheets and between anchor sheets and attachment pieces during the installation of the anchor sheet and attachment piece subfloors. The margin, being deformable, may be squeezed and will deform during atmospheric expansion of the anchor sheets to accommodate the change in size due to temperature changes or changes in atmospheric conditions. There are numerous structures that can serve as a deformable margin. In some cases, the deformable margin is collapsible, in that the margin will collapse under a force and not return to its original shape when the force is removed. In some cases, the deformable margin is resilient, in that after the margin is deformed by a force, it will return to its original shape after the force is removed. In some cases, the deformable margin is only partially resilient, in that it will return only part-way to its original shape after the force is removed. Over time, a resilient structure may begin to lose resiliency, for example if there is a "loss of memory" from use over time.

A second structure is a removable or detachable margin extending horizontally from the attachment pieces or anchor sheets. This removable margin creates a suitable spacing between anchor sheets and between anchor sheets and attachment pieces during the installation of the anchor sheet and attachment piece subfloors. Once removed, the margin leaves a space to accommodate the change in size of the anchor sheets due to temperature changes or changes in atmospheric conditions. There are numerous structures that can serve as a removable margin.

In a first aspect of the invention, there is provided an attachment piece for use in a subfloor with at least one anchor sheet, the at least one anchor sheet having a recess of a first shape in a first area, the anchor sheet having a complete cut of a second area of a second shape, and said second area lying within the first area, the attachment piece comprising: a first portion having an upper surface extending horizontally and shaped to fit in the recess; a second portion attached to the first portion and shaped to fit in the complete cut; the second portion having at least one resilient layer; a spacing structure; the spacing structure on at least one of the first portion or the second portion to establish a horizontal stand-off distance between the attachment piece and the at least one anchor sheet during installation.

In a feature of this aspect, the spacing structure is a deformable margin. In another feature of this aspect, the spacing structure is a removable margin on the first portion. In yet another feature of this aspect, the deformable margin is on the first portion. In still another feature of this aspect, the deformable margin is on the second portion. In yet another feature of this aspect of the invention, the deformable margin comprises a plurality of deformable protrusions. In still another feature of this aspect, the deformable margin is resilient or partially resilient. In yet another feature of this aspect, this aspect further comprises a countersunk hole for receiving a fastener.

In a second aspect of this invention, there is provided an attachment piece comprising a body extending axially and a head radially larger than the body formed on an axial end of the body, the head having a spacing structure, an aperture extending axially through the head and body for receiving a fastener and having a countersunk portion for recessing the head of the fastener at or below the surface of the head of the attachment piece, and a spacing structure located on either the body or the head, the spacing structure extending transverse to the axis. In a feature of this aspect, the spacing structure is a deformable margin. In another feature of this aspect, the spacing structure is a removable margin on the head. In yet another feature of this aspect, the deformable margin is on the head. In still another feature of this aspect of the invention, the deformable margin is on the body. In yet another feature of this aspect, the removable margin has a pull tab. In still another feature of this aspect, the deformable margin comprises a plurality of deformable protrusions around the perimeter of the attachment piece. In yet another feature of this aspect, the deformable margin is resilient or partially resilient.

In another aspect of the invention, there is provided an anchor sheet for use in a subfloor for detachable attachment to a decorative covering, the anchor sheet comprising: an upper surface having a means for detachable attachment to the decorative covering; a lower surface opposite the upper surface, the lower surface being covered with a resilient layer; a recess of a first shape reducing the thickness of the anchor sheet in a first area; a complete cut through the anchor sheet of a smaller second area within the first area of a second shape;

and a spacing structure positioned on the anchor sheet to space adjacent anchor sheets or attachment pieces.

In a feature of this aspect, the anchor sheet further comprises: the anchor sheet having at least two adjacent edges which have a lower portion cut away to create an overhanging area of anchor sheet and at least two adjacent lower edges substantially under the overhang; and the anchor sheet having at least two adjacent edges which have an upper portion cut away to create an underlay area of anchor sheet leaving at least two adjacent underlay edges at the outer edge of the underlay.

In another feature of this aspect, the spacing structure is a deformable margin. In yet another feature of this aspect, the spacing structure is a removable margin. In still another feature of this aspect, the spacing structure is in the first area. In yet another feature of this aspect, the spacing structure is in the second area. In still another feature of this aspect of the invention, the deformable margin is resilient or partially resilient. In yet another feature of this aspect, the deformable margin comprises a plurality of deformable protrusions.

In another aspect of the invention, there is provided a method of installing an anchor sheet and attachment piece subfloor over a floor, the subfloor to receive a detachable decorative covering, said anchor sheets having an upper surface having a means for detachable attachment to the decorative covering and a cut-away section of reduced thickness of a first area of a first shape and a complete cut through the anchor sheet of a smaller second area of a second shape within the first area, said attachment pieces having an upper surface having a means for detachable attachment to the decorative covering, and said attachment pieces having a spacing structure positioned to space surrounding anchor sheets, comprising the steps of: laying the anchor sheets over a floor; inserting the attachment pieces in the complete cut areas; and attaching at least some of the attachment pieces to the floor while arranging the surrounding anchor sheets so the surrounding anchor sheets touch but do not deform the spacing structures.

In a feature of this aspect, the anchor sheets are designed to overlap and the step of laying the anchor sheets over a floor consists of laying the anchor sheets in overlapping fashion over a floor. In yet another feature of this aspect, the spacing structure is a removable margin, and the method has the additional step of removing the spacing structures. In still another feature of this aspect of the invention, the spacing structure has a pull tab. In yet another feature of this invention, the spacing structure is a deformable margin. In still another feature of this invention, the deformable margin comprises a plurality of deformable protrusions. In yet another feature of the invention, the deformable margin is resilient or partially resilient.

In another aspect of the invention, there is provided a method of installing an anchor sheet and attachment piece subfloor over a floor, the subfloor to receive a detachable decorative covering, said anchor sheets having an upper surface having a means for detachable attachment to the decorative covering and a cut-away section of reduced thickness of a first area of a first shape and a complete cut through the anchor sheet of a smaller second area of a second shape within the first area, said attachment pieces having an upper surface having a means for detachable attachment to the decorative covering, and said anchor sheets having a spacing structure positioned to fend surrounding anchor sheets and attachment pieces, comprising the steps of: laying the anchor sheets over a floor; inserting the attachment pieces in the complete cut areas; and attaching at least some of the attachment pieces to the floor while arranging the surrounding anchor sheets so the anchor sheets and attachment pieces touch but do not deform the spacing structures.

In a feature of this aspect, the anchor sheets are designed to overlap and the step of laying the anchor sheets over a floor consists of laying the anchor sheets in overlapping fashion over a floor. In another feature of this aspect of the invention, the spacing structure is a removable margin, and the method has the additional step of removing the spacing structures. In still another feature of this aspect, the spacing structure is a deformable margin. In yet another feature of this aspect, the deformable margin comprises a plurality of deformable protrusions.

In another aspect of the invention, there is provided a floor for covering a structure to form a surface, the floor comprising: a plurality of anchor sheets; the plurality of anchor sheets being arranged to substantially cover the structure to form a floor having an upper surface; a plurality of passageways having walls extending from the upper surface of the floor to the structure below; the passageways having a portion countersunk from the upper surface of the floor, forming a first bearing surface below the plane of the floor; the plurality of attachment pieces being shaped to fit into the passageways, the attachment pieces having a wider upper portion to create a second bearing surface; the plurality of attachment pieces being inserted into the passageways such that the second bearing surface faces the first bearing surface in which at least some of the attachment pieces have a deformable margin to space the pieces from the walls of the passageway; and in which at least some of the attachment pieces with the deformable margin are attached to the floor.

In another aspect of the invention, there is provided an attachment piece for use with a floor formed from units to cover a structure, the floor having walled passageways extending from an upper surface of the floor to the structure below, the passageways having a portion countersunk from the upper surface of the floor forming a first bearing surface below the plane of the floor, the attachment piece comprising: a piece shaped to fit into the passageways having a wider upper portion to create a second bearing surface to face the first bearing surface on the countersunk portion of the passageway, and in which the attachment piece has a deformable periphery to space the piece from the walls of the passageway.

DETAILED DESCRIPTION

Figure 1:
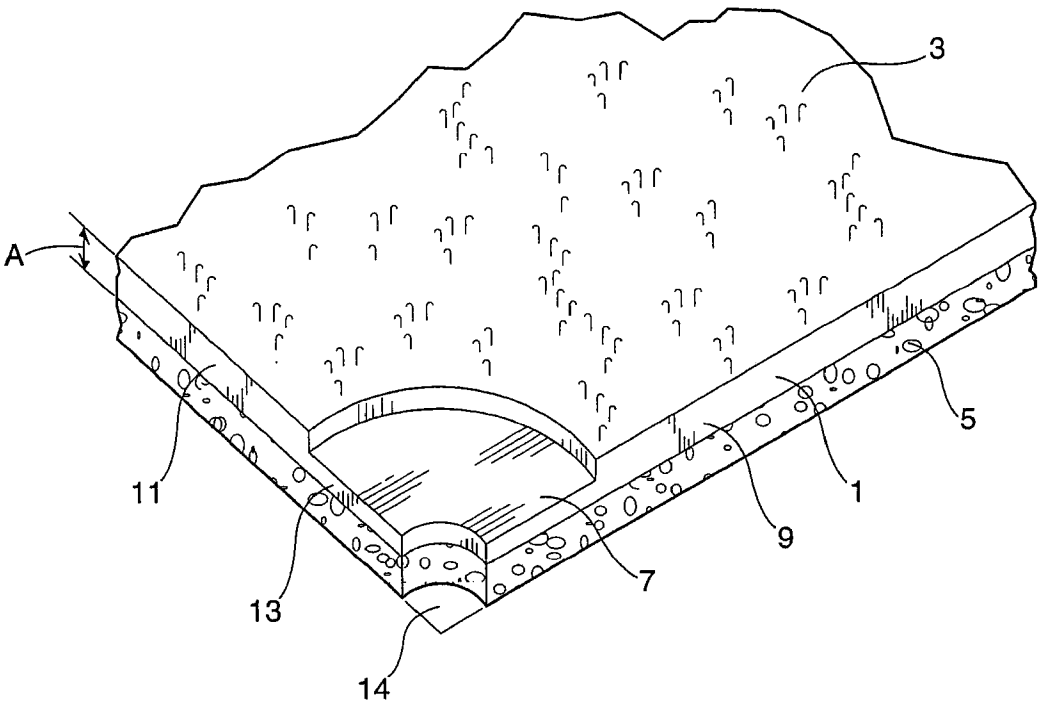
FIG. 1 shows a corner of an anchor sheet with an underpad.

The current invention relates to spacing structures for use with anchor sheets and attachment pieces as for instance in U.S. application Ser. No. 08/850,726 filed Jan. 16, 1998 and Ser. No. 09/008,584 filed Jan. 16, 1998, which when assembled can form a subfloor for detachable attachment of overlying decorative coverings. The attachment pieces (also called attachment devices or corner pieces) are shaped to fit into countersunk passageways formed through the anchor sheets when laid to cover a floor. If the attachment pieces are attached to the floor and not to the anchor sheets, the attachment pieces will hold down surrounding anchor sheets, while allowing the surrounding anchor sheets to ride under the attachment pieces while expanding and contracting with atmospheric changes.

This application incorporates by reference the teachings of current inventor's U.S. application Ser. No. 08/850,726 filed May 2, 1997, Ser. No. 09/008,565 filed Jan. 16, 1998 and Ser. No. 09/008,584 filed Jan. 16, 1998, except where those teachings may have been modified by new developments as set out herein.

There are advantages to having the anchor sheet and attachment piece subfloor attached at only a few discrete attachment points. In particular, if the sheets and attachment pieces are spaced apart, this will allow for a more stable subfloor in which the anchor sheets can expand and contract to accommodate atmospheric changes such as temperature and humidity. It is envisaged that the anchor sheets and attachment pieces can be made of polyethylene or polypropylene. However, even these materials expand and contract sufficiently to cause a subsurface without spaces to buckle because of temperature changes. The problems caused by the buckling of a subfloor may also be exacerbated by changes in a carpet attached to the subfloor. Therefore, there are advantages to allowing some form of spacing or floating between the anchor sheets.

It may be somewhat difficult for a layperson, or even an experienced carpet-layer, to place the anchor sheets and attachment pieces across a floor and attach the attachment pieces to the floor while providing for an acceptable spacing between the anchor sheets and between the anchor sheets and attachment pieces. This spacing must be adequate to allow for expansion and contraction, but cannot be so large as to provide for excessive "play" between adjacent anchor sheets.

In one embodiment, the improved attachment pieces incorporating a spacing structure have a deformable margin extending outwardly from the upper portion of the attachment piece. This deformable margin creates a suitable spacing between anchor sheets during the installation of the anchor sheets, and allows even a relative neophyte to install an anchor sheet subfloor with suitable spacing between anchor sheets. The margin, being deformable, may be squeezed and will deform during atmospheric expansion of the anchor sheets to accommodate the change in size due to temperature changes or changes in atmospheric conditions. There are numerous structures that can serve as a deformable margin. In some cases, the deformable margin is resilient (or partially resilient).

In an alternative, the improved attachment pieces incorporating a spacing structure have a removable margin extending outwardly from the upper portion of the attachment piece. This removable margin creates a suitable spacing between anchor sheets during the installation of the anchor sheets. Once the subfloor is installed, the removable margin may be removed, leaving spacing to accommodate atmospheric expansion and contraction of the anchor sheets due to temperature changes or changes in atmospheric conditions.

In a further alternative, the deformable margin or removable margin may be located on the anchor sheets rather than the attachment pieces. In another alternative, both the anchor sheets and attachment pieces have a deformable margin or a removable margin. In another alternative, the deformable margin may extend outwardly from the lower portion of the attachment piece. In a further alternative, the anchor sheets may have overlap or underlay regions to allow the anchor sheets to overlap, and a spacing structure may be found on either the overlap or underlay regions.

As shown in FIG. 1, a corner of an anchor sheet 1 is provided. It is possible to have the anchor sheet 1 provided in any shape that can be conveniently abutted with another similar piece to create a floor pattern such as, for instance, a square, a rectangle, a hexagon or an octagon. Generally the preferred shape will be an equilateral polygon but a rectangle may also work in some cases. The anchor sheet 1 contains a top surface layer 3 having hooks. In this embodiment anchor sheet 1 also contains a cushion 5 to provide resilience to the anchor sheet and to a decorative covering, such as for example, a carpet overlaid on top of the anchor sheet. However, cushioning is not necessary for the functioning of anchor sheet 1, but such cushioning can have advantages depending on the overlayment to be used and the intended use of the anchor sheet. In alternative embodiments, cushion 5 may also be replaced with a structure that will provide roughly equivalent resiliency to a cushion 5 such as, for instance, deformable pins or protrusions.

In practice, the hooks of the top surface layer 3 will be attached to the loops of an overlying carpet (not shown) when an entire anchor sheet subfloor has been installed. The anchor sheet has a thickness A. The appropriate thickness A will depend on the intended use of the anchor sheet, and may vary with the type of overlayment to be used. The thickness A will not be substantially less than 0.020 inches and generally will not be less than 0.062 inches. The preferred thickness A is around 0.125 inches, but the thickness A may be as much as 0.75 inches, for example in situations where a thick floor is to be replaced, or where a thick anchor sheet needs to be used to create a level surface with an adjacent surface. Cutaway from that thickness is an area 7 which will be shaped into some geometric shape, in this case a portion of a circle, so that when combined with similar abutting anchor sheets aligned along sides 9 and 11, a ¾ circular cut away area will be formed. A fourth anchor sheet diagonally opposite anchor sheet 1 will form a complete circle having a circular cut away area as described below. Typically, the cut-away area will be such that the thickness of the anchor sheet at 13 will be approximately half of the total thickness A of the anchor sheet. However, the width of the anchor sheet at 13 may be other than approximately half the total thickness A and still incorporate the teachings of this patent. In addition, there is a second area 14 which has been cut out from the corner (the apex of the angle formed by the two sides of the square). This second area 14 also has a geometric shape, in this example a ¼ of a circle, so that when combined with other anchor sheets, the anchor sheet edges are lined up so that their corners meet at the imaginary intersection of the four corners, and a second smaller circle will be formed in the completed anchor sheet structure.

As shown in FIG. 1, in a preferred embodiment, the thickness A is ⅛ of an inch (0.125 inches), and the thickness of the anchor sheet at 13 is 1/16 of an inch (0.0625 inches). The thickness of the cushion 5 will be either approximately ¼ of an inch or ⅜ of an inch depending on the desired resiliency and amount of surface traffic. The hooks of the top surface layer 3 will have a density that may range from 160-1200 hooks per square inch, with a preferred density of approximately 330 hooks per square inch.

The preferred materials for the anchor sheet 1 and cushion 5 are polypropylene and polyethylene. In a preferred embodiment, the cushion 5 is made from linear low density polyethylene with a density of approximately 30 kg/m$^3$. Other foams could be used such as polyurethane or rubber.

The anchor sheets 1 may be any size convenient for sale, transportation or installation, typically in the range of 12 inch by 12 inch square to 36 inch by 36 inch square. In a preferred embodiment, anchor sheet 1 is an approximately 24 inch by 24 inch square. In a second preferred embodiment, anchor sheet 1 is an approximately 25 inch by 25 inch square.

In a preferred embodiment, the cut away area 7 is circular in shape with a radius of 3 inches centred on the apex of the angles of sides 9 and 11. Cut out area 14 is circular in shape with a radius of 2 inches centred on the apex of the angles of sides 9 and 11. However, the cut away and cut out areas may vary in size.

Figure 4:
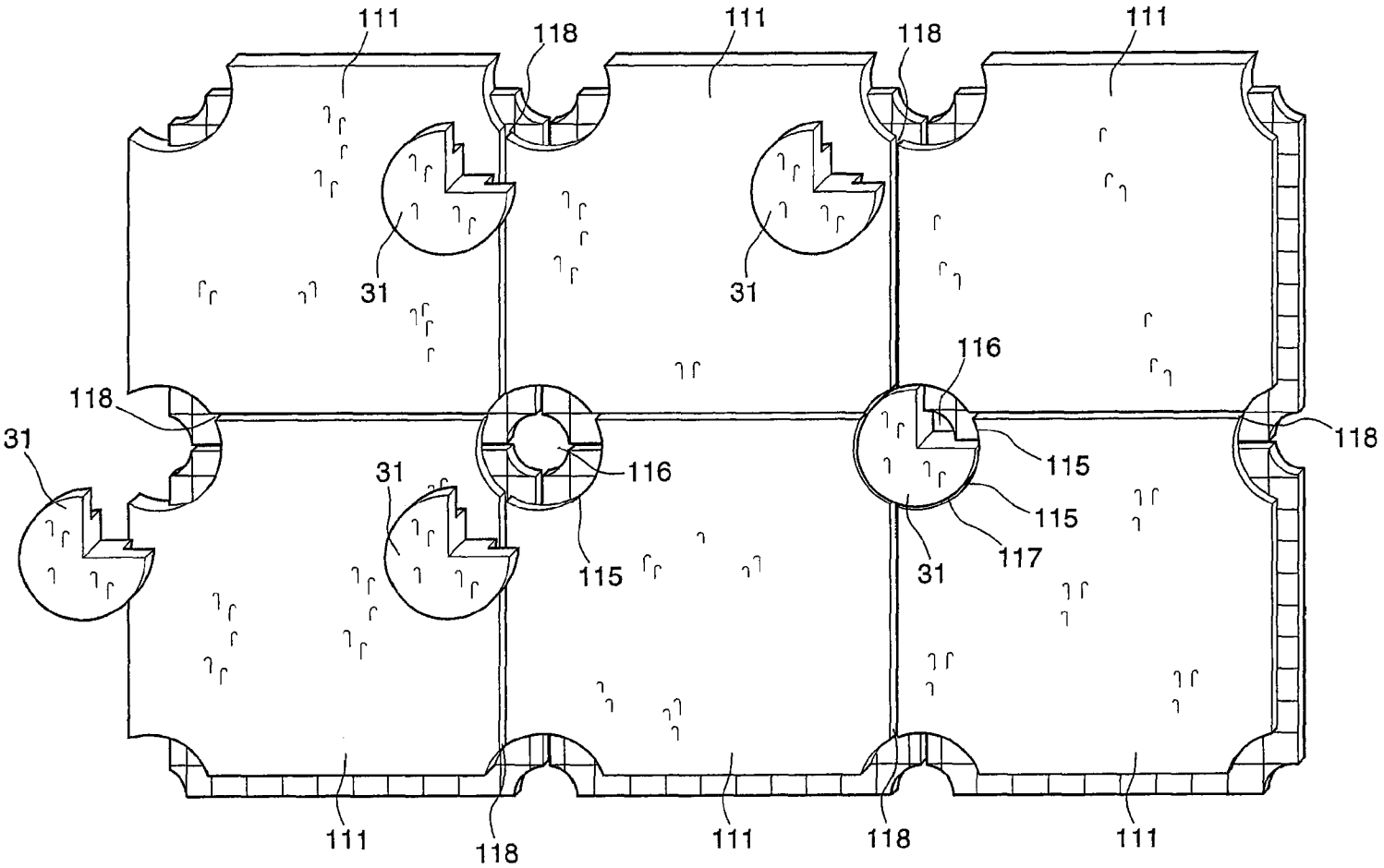
FIG. 4 shows a plan view of a partially assembled subfloor of anchor sheets (having overlapping edges and cutaway and cut out portions for the attachment pieces) and attachment pieces in partial section.

Thus, a circular cut out area 14 within a second larger circular cut away area 7 is created when four similar anchor sheets abut each other. A complementary attachment piece (as shown in FIGS. 2 and 4) can then be added which will match the shape and thickness of the reduced thickness portion and the shape and thickness of the cut out area.

Figure 2:
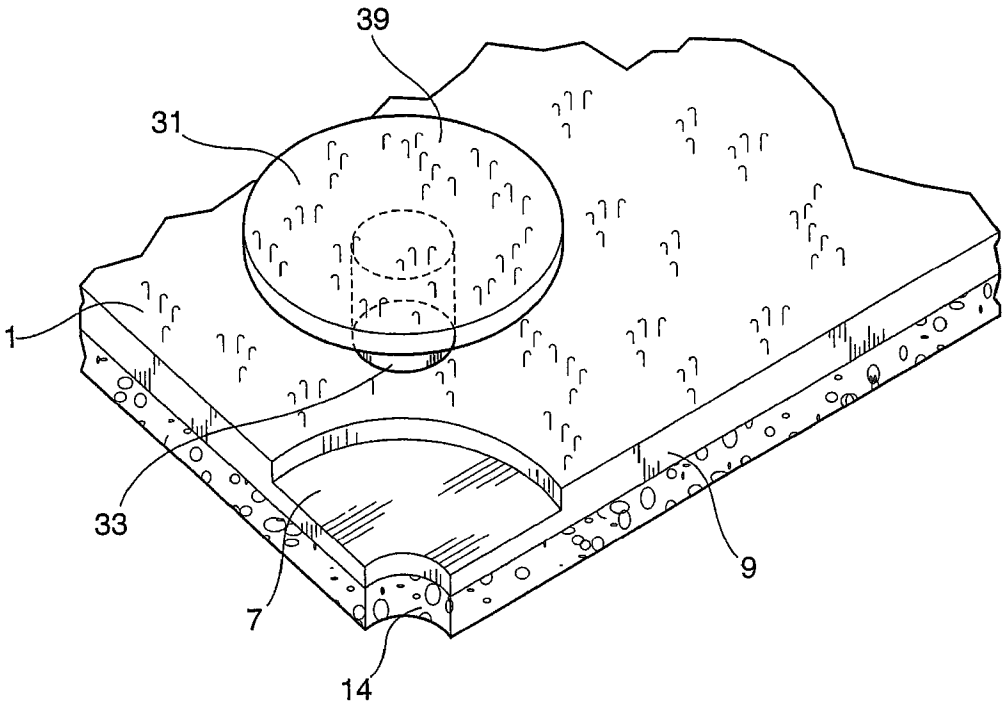
FIG. 2 shows an attachment piece which could be used with the anchor sheet of FIG. 1.

FIG. 2 shows a attachment piece 31 which consists of an upper portion 39 and a lower portion 33. Lower portion 33 matches in geometric shape the cut out portion 14 shown in FIG. 2, a shape that will be formed by all of abutting four anchor sheets 1. (This lower portion 33 will therefore normally be shaped to correspond to the shape of the cut out portion 27 from FIG. 3) In this case, it is a simple circle. This will be the preferred shape, although, of course polygons or other shapes are also possible and the lower portion of the attachment piece 33 need not be the same shape as the cut out portion 14.

Similarly, the upper portion of the attachment piece 39 is shaped to correspond to the cutaway portion 7. Again, this is a circle but could be another shape, particularly an equilateral polygon and the upper portion 39 need not be the same shape as cut away section 7. The upper portion 39, lower portion 33, cut away area 7 and cut out area 14 need not be the same shape, and could even be of four different shapes. In FIG. 2 the attachment piece could be attached to the anchor sheet in the cutaway portion area 7 and thus form an attachment between four contiguous anchor sheets.

The upper portion 39 and lower portion 33 of the attachment piece 31 will be covered with a rigid layer, may incorporate a rigid layer, or alternatively may simply consist of a rigid material. In a preferred embodiment, upper portion 39 is a rigid disk of 1/16 of an inch thick polypropylene or polyethylene in the shape of a circle with a six inch diameter. Lower portion 33 is a circular cylinder with a diameter of four inches, comprising a cushion layer ⅜ of an inch thick attached to upper portion 39 with a rigid layer of 1/16 of an inch thick polypropylene or polyethylene on the bottom of the cushion.

Fastening devices such as hook and loop or a screw, or nail, or liquid adhesive, or pressure-sensitive adhesive, can be used to attach the attachment pieces to a floor thereby holding the anchor sheet subfloor to the floor at only a few discrete points by use of the attachment pieces, with or without direct attachment to the anchor sheets to the floor or the attachment pieces.

Figure 3:
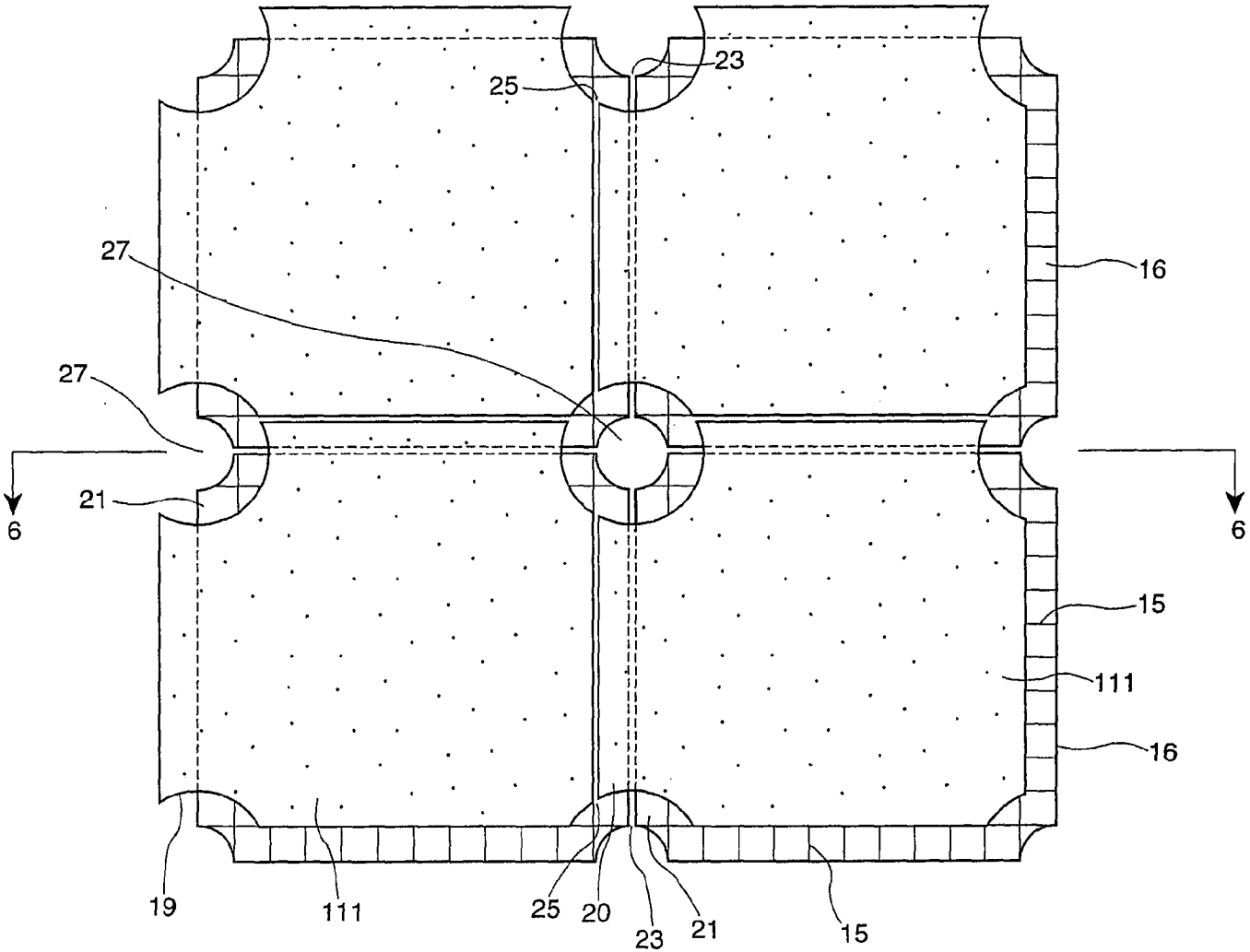
FIG. 3 shows a plan view of a partially assembled subfloor of anchor sheets having overlapping edges and cutaway and cut out portions for the attachment pieces.

An arrangement of overlapping anchor sheets and attachment pieces to form a subfloor can be seen in FIG. 3. In FIG. 3, a plurality of anchor sheets 111 are shown. In this example they are squares. Unlike the embodiment of anchor sheet in FIG. 1, however, these anchor sheets 111 do not abut each other in one plane only. Rather, the anchor sheets 111 in this embodiment have an underlay area 15 in which there is a lower portion edge 16. Underlay area 15 is indicated in FIG. 3 by a grid marking, but underlay area 15 is part of anchor sheet 111. Underlay area 15 lies under the overlap area 19 on an adjacent sheet. The overlap area 19 in this example extends on two sides of each sheet, whereas the underlay area 15 extends on the other two sides. The overlap area 19 overlaps the underlay area 15 of each sheet, for instance along the area 20 shown in FIG. 3 (the area between the top abutment edge and the nearest parallel dotted line). An area of reduced thickness 21 is formed surrounding where the apex of the underlay edges 15 would have been. In this case, the cutout is centred over the space 23 between the lower portion edges of the adjacent anchor sheets. It is not centred over the corner line of space 25 created between the overlap edges extending over the area of overlap 19. In addition to the reduced thickness area 21 (similar to area 7 in FIG. 1) there is a completely cut out portion 27.

As shown in FIG. 3, the sheets 111 have between them spaces 23 and 25, thus leaving room for expansion and contraction.

FIG. 4 illustrates the use of attachment pieces 31 of FIG. 2 with the anchor sheets 111 of FIG. 3. Attachment pieces 31 are shown in partial section view. Specific attachment piece 113 is shown placed within a circle 115 and a completely cut away circle 116 created by the corners of the four anchor sheets 111. Since the radius of attachment piece 113 is less than the radius of circle 115, a space 117 is created between attachment piece 113 and surrounding anchor sheets 111 to allow for atmospheric expansion. In addition, spaces 118 are created between neighbouring anchor sheets 111.

In a preferred embodiment, the anchor sheets 111 of FIG. 3 are ⅛ of an inch thick, and the thickness of the anchor sheet 111 at underlay area 15 and at overlap area 19 and at area of reduced thickness 21 is 1/16 of an inch.

The anchor sheets 111 may have a cushion layer (not shown) attached to its bottom side. In a preferred embodiment, the thickness of thus cushion layer will be either approximately ¼ of an inch or ⅜ of an inch depending on the desired resiliency and amount of surface traffic. In a preferred embodiment, the hooks of the top surface layer of anchor sheet 111 will have a density that may vary from 160 to 1200 hooks per square inch, with a preferred density of approximately 330 hooks per square inch.

The preferred materials for the anchor sheet 111 and its optional cushion layer are polypropylene and polyethylene. In a preferred embodiment, the cushion layer is made from linear low density polyethylene with a density of approximately 30 kg/m$^3$. Other foams could be used such as polyurethane or rubber.

In a preferred embodiment, anchor sheet 111 of FIG. 3 (extending the sides of underlay area 15 and overlap area 19 so they meet at imaginary corners) is an approximately 24 inch by 24 inch square. In a second preferred embodiment, anchor sheet 111 (extending the sides of underlay area 15 and overlap area 19 so they meet at imaginary corners) is an approximately 25 inch by 25 inch square. However, the anchor sheets may be any size convenient for sale, transportation or installation, typically in the range of 12 inch by 12 inch square to 36 inch by 36 inch square. Underlay area 15 and overlap area 19 are each approximately one inch in width.

In a preferred embodiment, circle 115 of FIG. 4 and completely cut out circle 116 of FIG. 4 are centred on the apexes of the angles formed by extending lower portion edges 16 of FIG. 3. Circle 115 has a diameter of six inches, while completely cut away circle 116 has a diameter of four inches.

Figure 7:
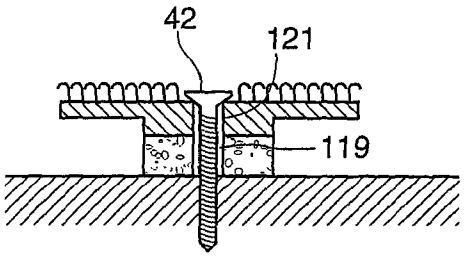
FIG. 7 is a plan view of an attachment piece with a fastener (on the same page as FIG. 5).

The attachment pieces 31 could be attached to the underlying floor by use of a screw 42 as shown in FIG. 7, and the anchor sheets can remain free-floating. Space 119 can optionally be maintained in the screw hole 121 by having the radius of screw hole 121 be larger than the radius of screw 42, allowing for movement of the attachment pieces 31 around screw 42. Fasteners other than a screw may also be used.

Figure 5:
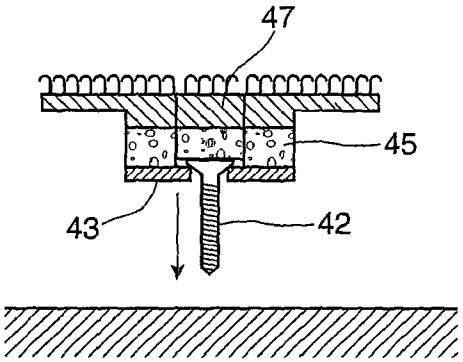
FIG. 5 shows an attachment piece in section with attached cushion and countersunk fastener.

As shown in FIG. 5, it is also possible to have the fastener (here, a screw) countersunk. In this case if the anchor sheet has a cushion 45, a rigid layer 43 is provided attached to the cushion 45. A plug 47 is removed from the rigid layer 43 and cushion 45. After the screw has been attached to the subfloor, the plug 47 is reinserted to create a smooth upper surface of cushion and anchor sheet, or the plug can simply be filled with cushion or any other suitable material or the removed plug of material 47 can simply not be replaced leaving a small cavity in the attachment piece.

Figure 6:
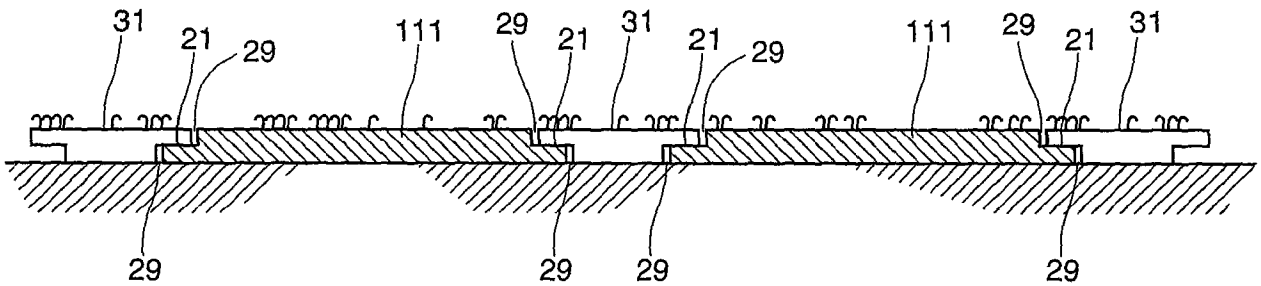
FIG. 6 is a section view of an anchor sheet along the lines 6-6 in FIG. 3 with attachment pieces inserted (on the same page as FIG. 5).

FIG. 6 is a section taken along the line 6-6 in FIG. 2 with attachment pieces 31 inserted into the spaces 27. It shows attachment pieces 31 which overlap areas of reduced thickness 21 on anchor sheets 111. The anchor sheets 111 are free to ride between two attachment pieces 31, as a tolerance or space 29 has been created between anchor sheets 111 and attachment pieces 31 as described above. Attachment pieces 31 would normally be attached to the underlying substrate with a screw or other fastener (not shown). It is also possible to attach some of the attachment pieces partially or wholly to the anchor sheets 111 through attachment to areas of reduced thickness 21, allowing the attached anchor sheets 111 and attachment pieces 31 to float on the substrate.

The placement of the attachment pieces at the corners reduces the number of attachment points required, because each attachment piece overlaps four sheets. Because the corners of anchor sheets are an area of weakness there is less likely to be discontinuities or breakage with this attachment system. In addition, because fewer attachment points are required there is less degradation to the integrity of the anchor sheet because there are fewer holes in the anchor sheet. Having attachment pieces at the corners also limits irregularities where the anchor sheets meet caused by deviations in the floor. Finally, because the attachment pieces hold the anchor sheets down without a direct attachment of the anchor sheets to the underlying floor, it is possible to allow for movement of the anchor sheets in relation to the attachment pieces, including the handling of atmospheric expansion.

While attachment pieces located on corners of the anchor sheets have been described, it is possible to use the invention by providing a reduced thickness area along any edge of a modular anchor sheet and having a cut out area within the reduced thickness area to provide a structure for use of the attachment pieces described at that point. A reduced thickness area surrounding a cut out area may also be located anywhere in the interior of an anchor sheet for use of the attachment pieces at that interior point.

If the anchor sheets are held to the floor only via the attachment pieces, the anchor sheets can easily be removed and replaced if they are defective or require repair.

It is expected that the anchor sheets would likely be square, and preferably in the range of 36 inches by 36 inches to 12 inches by 12 inches, although anchor sheets outside of this range are also functional and fall within the scope of this invention.

The anchor sheets could be made of an extruded or molded material in which the two pieces are thermally bonded so as to form an overlap and underlay. The sheets could be cut by a gauge or jig. The anchor sheets could be die cut. A layer of hooks could be thermally bonded to the surface of the top sheet. Alternatively, the complete anchor sheet (potentially including hooks, and the two "layers" of the anchor sheet) could be injection-molded using a one- or two-step or multi-step process mold, using materials such as polypropylene or polyethylene.

The overlap and underlay areas of the anchor sheets may be provided with means for detachable or permanent attachment, or the underlay areas may simply lie underneath and support the overlap areas without any form of attachment. Alternatively, the anchor sheets may also be made with corresponding registering bumps and indentations (not shown) in the overlap and underlay portions of the anchor sheets to assist in retaining the anchor sheets together and in alignment during installation.

In all cases where hook and loop systems or hooks are provided for, the hooks may be temporarily covered by a hard slip covering as discussed in U.S. application Ser. No. 08/850,726 or a soft covering as disclosed in U.S. Pat. No. 4,822,658 to temporarily prevent premature engagement of the hooks to loops.

As noted above, it is desirable to leave a space between the anchor sheets 111 and attachment pieces 31 (as illustrated in FIG. 6), and between adjacent anchor sheets 111, while attaching the attachment pieces to the floor. The creation of the spacing between the attachment pieces and the anchor sheets during installation of a subfloor is difficult. The installation of a subfloor with appropriate spacing is aided by use of spacing structures in accordance with this invention.

In one embodiment, the improved attachment pieces incorporate a deformable margin around the edge of the attachment pieces. This deformable margin allows the anchor sheets to be placed with spacing to allow for atmospheric expansion. However, the deformable margin deforms during periods of expansion of the anchor sheets due to atmospheric changes to allow for expansion of the anchor sheets. In some embodiments, the deformable margin is resilient, and so will shrink and expand in a manner to accommodate the expansion and shrinkage of the anchor sheets. However this is not necessary to operate effectively so that a collapsible non-resilient margin could also be effective.

Figure 8B:
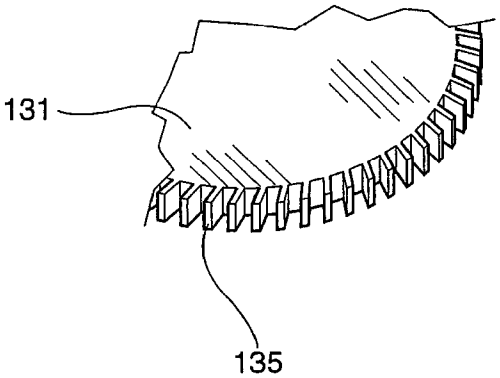
FIG. 8B shows the details of the protrusions extending outwardly from the attachment piece of FIG. 8A.
Figure 8A:
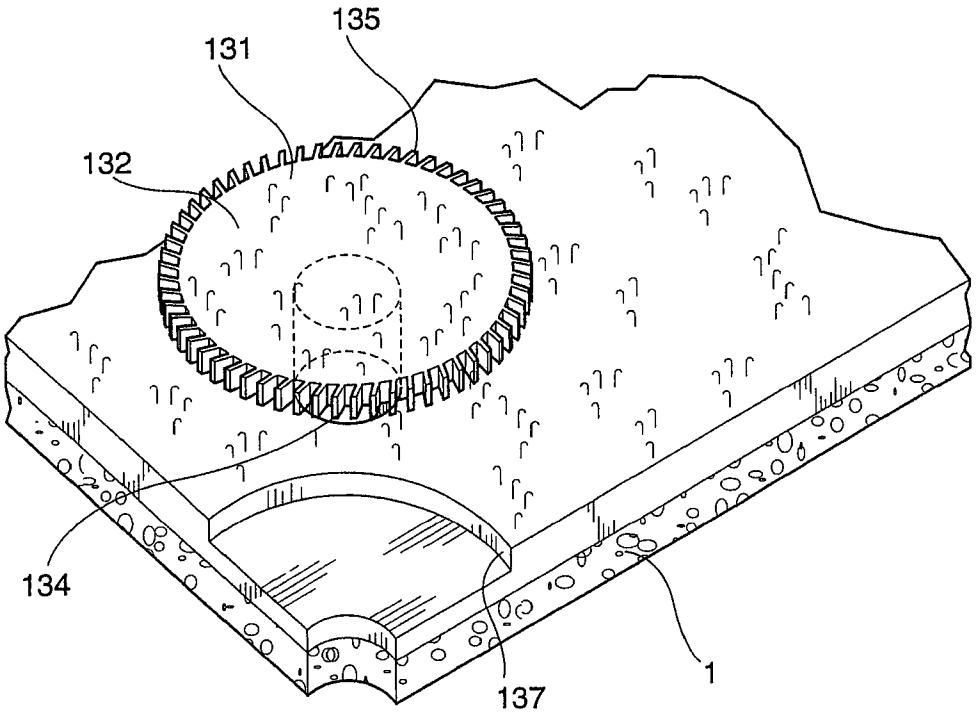
FIG. 8A shows an attachment piece incorporating a spacing structure, with outward protrusions about its upper portion.

FIG. 8A shows one embodiment of the improved attachment pieces incorporating a spacing structure. Turning to FIG. 8A, an improved attachment piece 131 is illustrated, which generally corresponds in shape and composition to attachment piece 31 from FIG. 2. Improved attachment piece 131 has upper portion 132 and lower portion 134 whose geometric shape corresponds to the geometric shape of the sections cut-away and cut out from anchor sheet 1. The upper portion 132 and lower portion 134 of the improved attachment piece 131 will be covered with a rigid layer, may incorporate a rigid layer, or alternatively may simply consist of a rigid material. In a preferred embodiment, upper portion 132 is a rigid disk of 1/16 of an inch thick polypropylene or polyethylene in the shape of a circle with a six inch diameter. Lower portion 134 is a circular cylinder with a diameter of four inches, comprising a cushion layer 3/8 of an inch thick attached to upper portion 132 with a rigid layer of 1/16 of an inch thick polypropylene or polyethylene on the bottom of the cushion. In a preferred embodiment, the cushion is made from linear low density polyethylene with a density of approximately 30 kg/m$^3$. In a preferred embodiment, the hooks on upper portion 132 have a density of 330 hooks per square inch.

Extending outward from upper portion 132 of improved attachment piece 131 are a plurality of deformable protrusions 135. By "protrusions" is meant any part of the margin extending outwardly. Such protrusions may be in the form of fingers, fins, bumps, bulges or any structure extending from the margin of the attachment piece and could include any irregularity or pattern in the margin wherein one portion of the margin can deform. As may be seen in FIG. 8B, a closeup of an edge of improved attachment piece 131, protrusions 135 have some vertical depth transverse to their outward aspect. Preferably, the protrusions 135 do not lie exactly along an extended radius of the upper portion 132, but are at an angle to the radii to better allow for deformation and recovery to their previous position. In one embodiment, protrusions 135 will be resilient, whereas in another embodiment protrusions 135 will only be collapsible. In operation, improved attachment piece 131 is attached to the floor. Anchor sheets 1 are arranged around improved attachment piece 131, so that the edges 137 touch but do not deform protrusions 135. This will create a space to allow for expansion or contraction of anchor sheets 1, similar to space 117 in FIG. 4. Improved attachment piece 131 will also operate with overlapping anchor sheets 111, as shown in FIGS. 3 and 4. The plurality of protrusions 135 form one embodiment of a deformable margin.

The length of the extending plurality of protrusions 135 should be sufficient to accommodate the expected maximum expansion of the anchor sheets. In a preferred embodiment, where the anchor sheet is 0.125 inches thick at its widest point and is a 24 inch by 24 inch polypropylene anchor sheet, the margin should deform to allow for a minimum 1/16 of an inch (0.0625 inch) deformation. This expected expansion can be calculated using known coefficients and formulae. One such typical formula is the linear coefficient of expansion of a material times the length of that material (or half the length of the material for one side) times the change in temperature. We typically consider the maximum expansion over a range of approximately 70 degrees Fahrenheit. While the expansion can depend upon many factors, within the range of preferred thicknesses and in this use, the relevant factors are the horizontal dimensions of the anchor sheet, the material from which the anchor sheet is constructed and the range of temperature over which the material is used. 1/16 of an inch is preferred for a 24 inch by 24 inch homopolymer polypropylene anchor sheet which is 0.125 inches thick at its widest point. This will provide for sufficient expansion and contraction in most practical uses for homopolymer polypropylene and with this anchor sheet size.

Figure 9A:
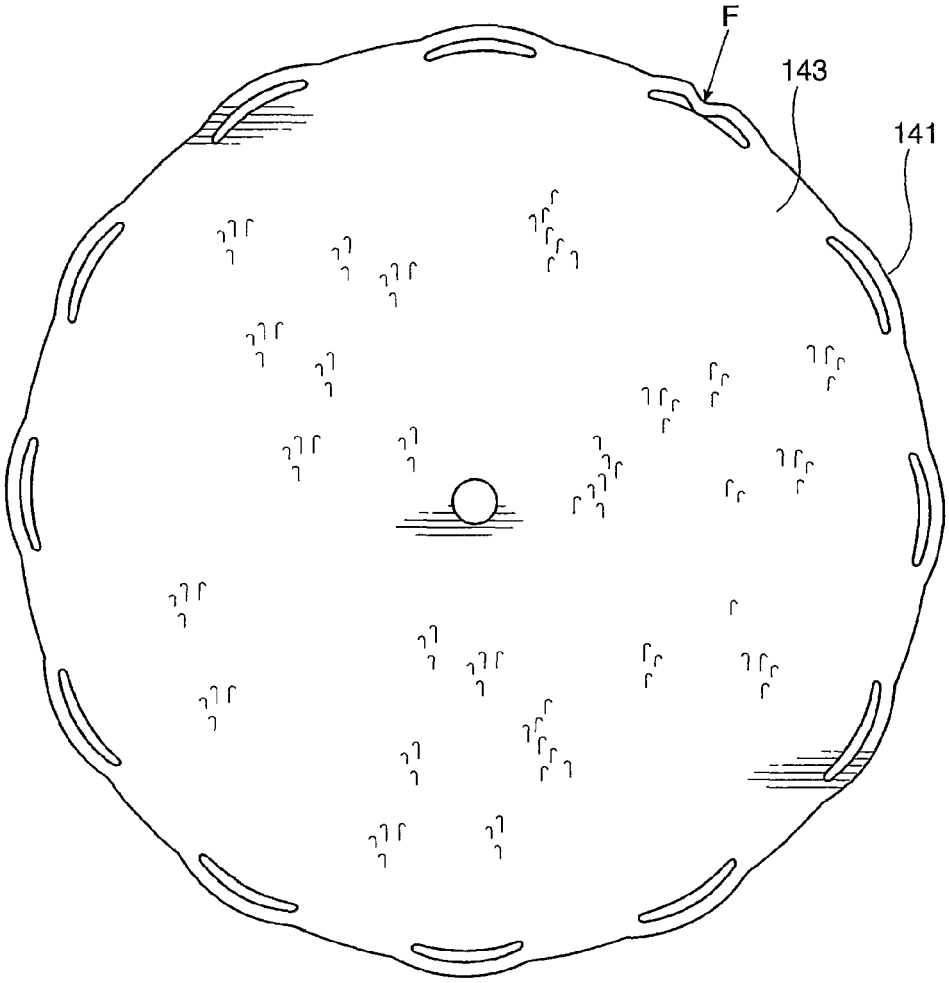
FIG. 9A is a top view of an attachment piece incorporating a spacing structure, with a resilient outer structure.
Figure 9B:
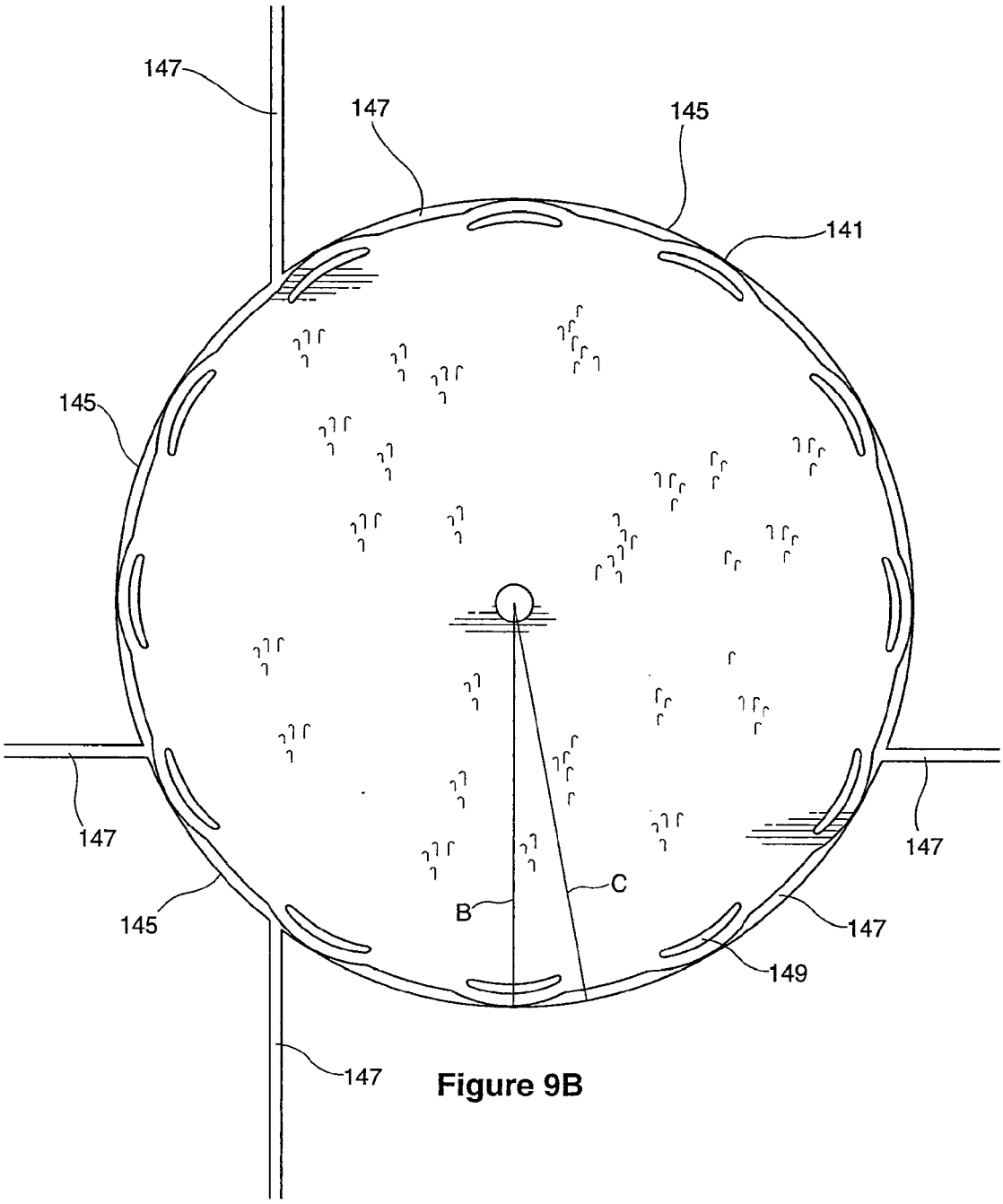
FIG. 9B shows the improved attachment piece of FIG. 9A, where the resilient outer structure is shown creating a spacing between four adjacent anchor sheets.

FIG. 9A shows another embodiment of the improved attachment pieces incorporating a spacing structure. Turning to FIG. 9A, in this embodiment, a deformable margin is created by having raised bumps 141 extending radially outwardly from the top surface of improved attachment piece 143. The raised bumps are a form of protrusion as discussed above. When a force, such as force F in FIG. 9A, is applied to these bumps, they will deform inwards towards the centre of improved attachment piece 143. In one embodiment, these bumps will be resilient, and will return to their resting, expanded shape. (after use, the bumps may lose some of their resiliency due to "loss of memory" effects) In another embodiment, the bumps may be simply collapsible when a force F is applied. In operation, these attachment pieces may be attached to a floor, and anchor sheets may be arranged around undeformed bumps 141 to create a outer circumference of anchor sheets 145 as indicated in FIG. 9B. This will create a spacing 147, which can accommodate atmospheric expansion in the anchor sheets.

In a preferred embodiment, where the anchor sheet is 0.125 inches thick and is a 24 inch by 24 inch square made from homopolymer polypropylene, notches 149 will have a maximum width (along a radius from the centre of the disk) of approximately 0.1 inches. In the same preferred embodiment, the undeformed bumps 141 may have a distance from the outer point of the bump to the nominal edge of the disk (or length B minus length C in FIG. 9B) of approximately 0.083 inches. Note that this will create a space 147 of approximately 0.083 inches, which is sufficient to allow the minimum deformation of 1/16 of an inch (0.0625 inches) as discussed above.

Figure 10:
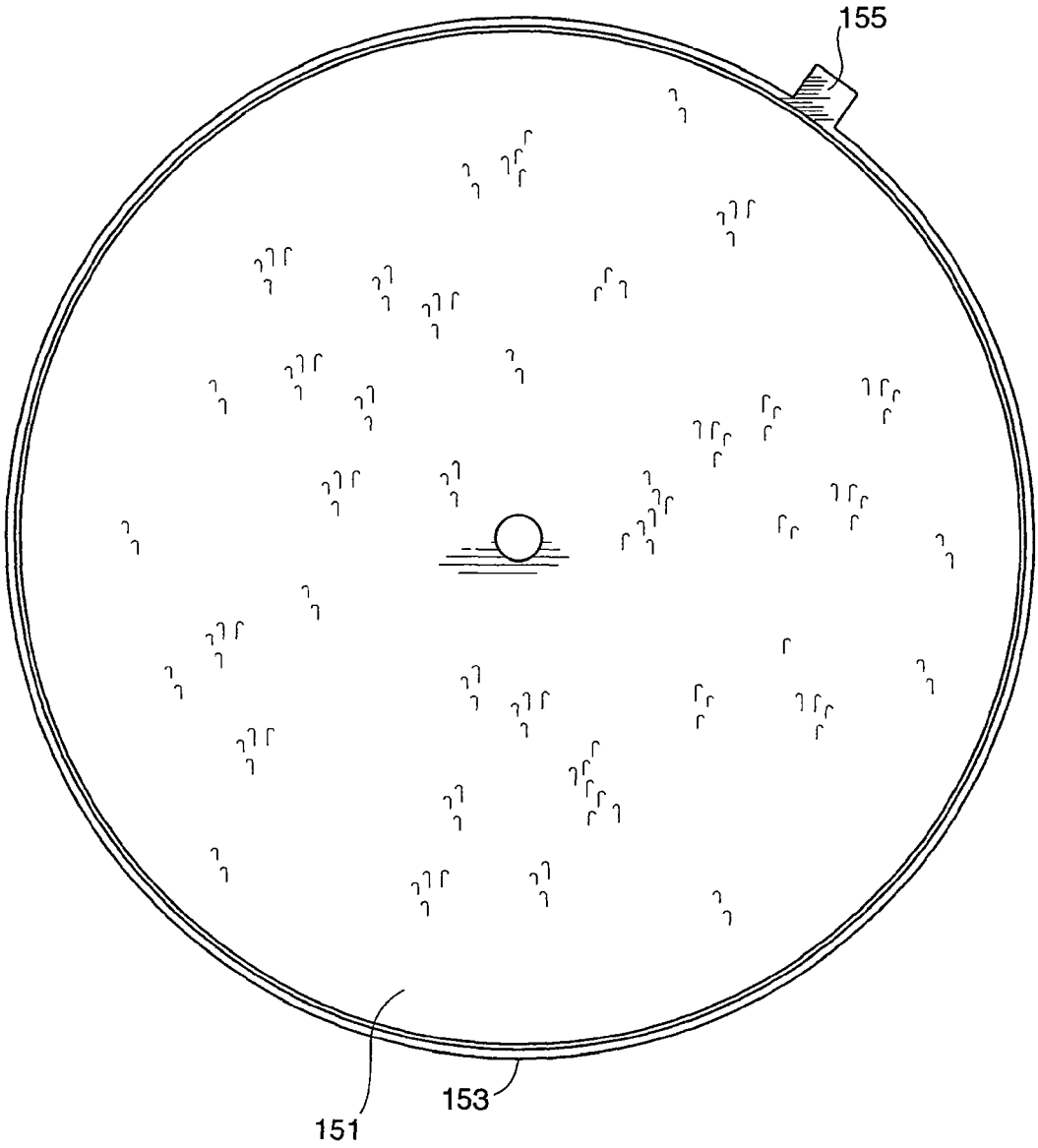
FIG. 10 is a top view of an attachment piece incorporating a spacing structure, with a detachable or removable circumferential strip.

Another alternative embodiment of the improved attachment pieces incorporating a spacing structure is shown in FIG. 10. Turning to FIG. 10, the circumference of attachment piece 151 is surrounded by a removable or detachable strip of material 153. The removable strip of material 153 is attached to a pull tab 155. In operation, the improved attachment piece 151 would be attached to the floor. Anchor sheets would be arranged around improved attachment piece 151, so that they touch the edge of removable strip of material 153. Once the subfloor has been installed across the floor surface to be covered, removable strips of material 153 may be removed by pulling upon pull tabs 155. Once removable strips of material 153 have been removed, space equivalent to space 117 in FIG. 4 will have been created between adjacent anchor sheets, allowing for atmospheric expansion.

In a preferred embodiment, where the anchor sheet is 0.125 inches thick and is a 24 inch by 24 inch square of homopolymer polypropylene, the removable strip of material 153 extends 1/16 of an inch (0.0625 inches) from the side of the attachment piece. Note that, after removal of the removable strip, a surrounding circumference of space will be left which is sufficient to allow the minimum deformation of 1/16 of an inch (0.0625 inches) as discussed above.

While the improved attachment pieces incorporating a spacing structure discussed under FIG. 8A to 10 have been described as having a deformable or removable margin around their upper portions, a person skilled in the art would know the improved attachment pieces incorporating a spacing structure could also have a deformable or removable margin around their lower portion and still operate within the spirit of the invention. One such improved attachment piece incorporating a spacing structure is illustrated in FIG. 11.

Figure 11:
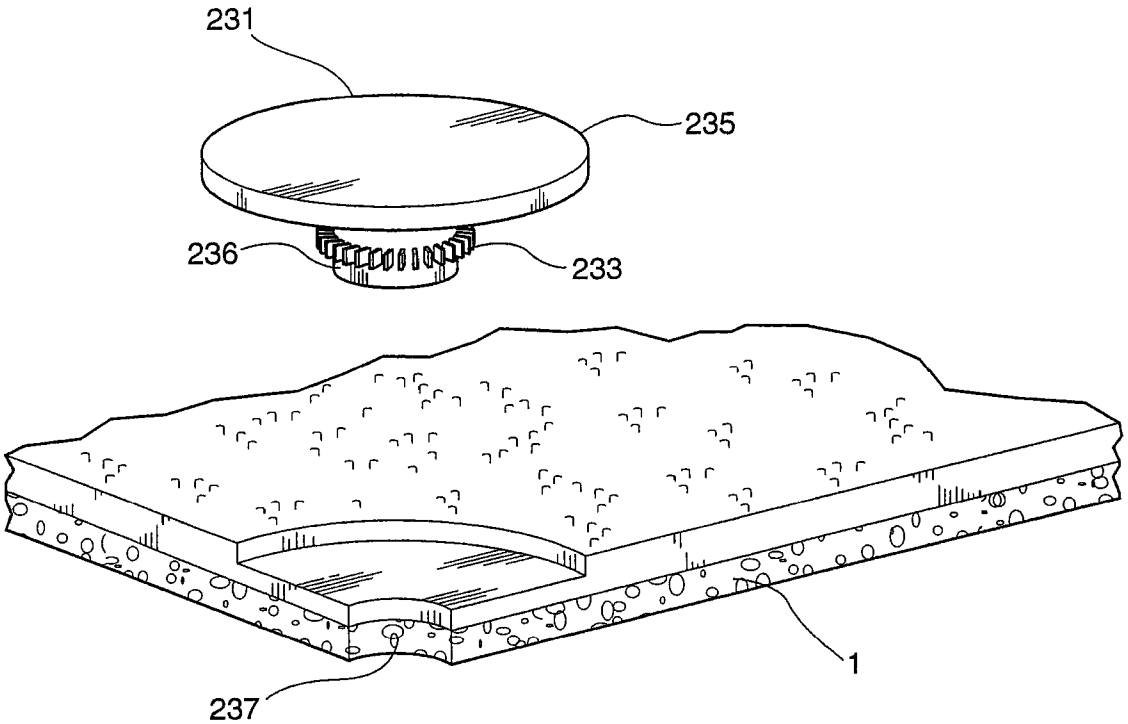
FIG. 11 shows an attachment piece incorporating a spacing structure, with outward protrusions about its lower portion.

Turning to FIG. 11, an improved attachment piece incorporating a spacing structure 231 is illustrated, which generally corresponds in shape and composition to attachment piece 31 from FIG. 2. Improved attachment piece 231 has upper portion 235 and lower portion 236 whose geometric shape corresponds to the geometric shape of the sections cut-away and cut out from anchor sheet 1. Extending outward from the lower portion 236 of improved attachment piece 231 are a plurality of protrusions 233. In one embodiment, protrusions 233 will be resilient, whereas in another embodiment protrusions 233 will be collapsible. In operation, improved attachment piece 231 is attached to the floor. Anchor sheets 1 are arranged around improved attachment piece 231, so that the edges 237 touch but do not deform protrusions 233. This will create a space to allow for expansion or contraction of anchor sheet 1, similar to space 117 in FIG. 4. Improved attachment piece 231 will also operate with overlapping anchor sheets 111, as shown in FIGS. 3 and 4. The plurality of protrusions 233 constitute one type of deformable margin.

Figure 12:
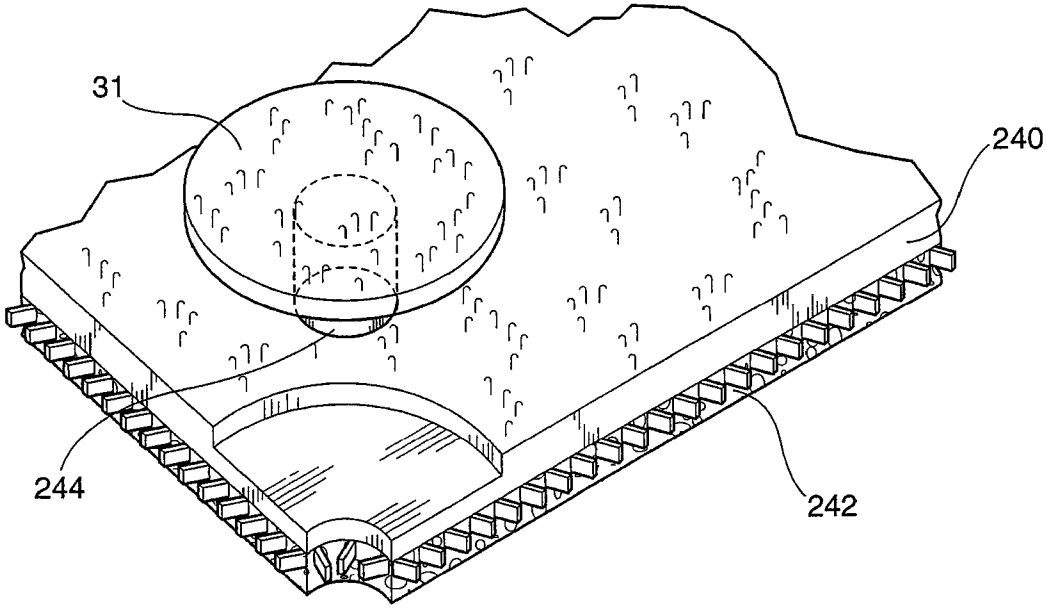
FIG. 12 shows an anchor sheet incorporating a spacing structure, with protrusions along its lower edge.

The deformable or removable margin may also appear on anchor sheets, rather than the attachment pieces. In FIG. 12, an anchor sheet incorporating a spacing structure 240 is the same as anchor sheet 1 from FIG. 2 with the addition of a plurality of protrusions 242, extending outwards from the lower portion of improved anchor sheet 240. In one embodiment, protrusions 242 will be resilient, whereas in another embodiment protrusions 242 will be collapsible. In operation, attachment piece 31 is attached to the floor. Improved anchor sheets 240 are arranged around improved attachment piece 31, so that edge 244 of attachment piece 31 touches but does not deform protrusions 242. This will create a space to allow for expansion or contraction of improved anchor sheet 240, similar to space 117 in FIG. 4. This improvement will also operate with overlapping anchor sheets 111, as shown in FIGS. 3 and 4. The plurality of protrusions 242 constitute one type of deformable margin. A removable margin may also be used if it is located near the top of the anchor sheet. Generally such protrusions, deformable margins, or removable margins could have the same shape and dimensions as a similar protrusions, deformable margins, or removable margins on the attachment piece.

It is possible to design the protrusions 242 so that protrusions on adjacent anchor sheets can interlock when the anchor sheets are installed.

Figure 13:
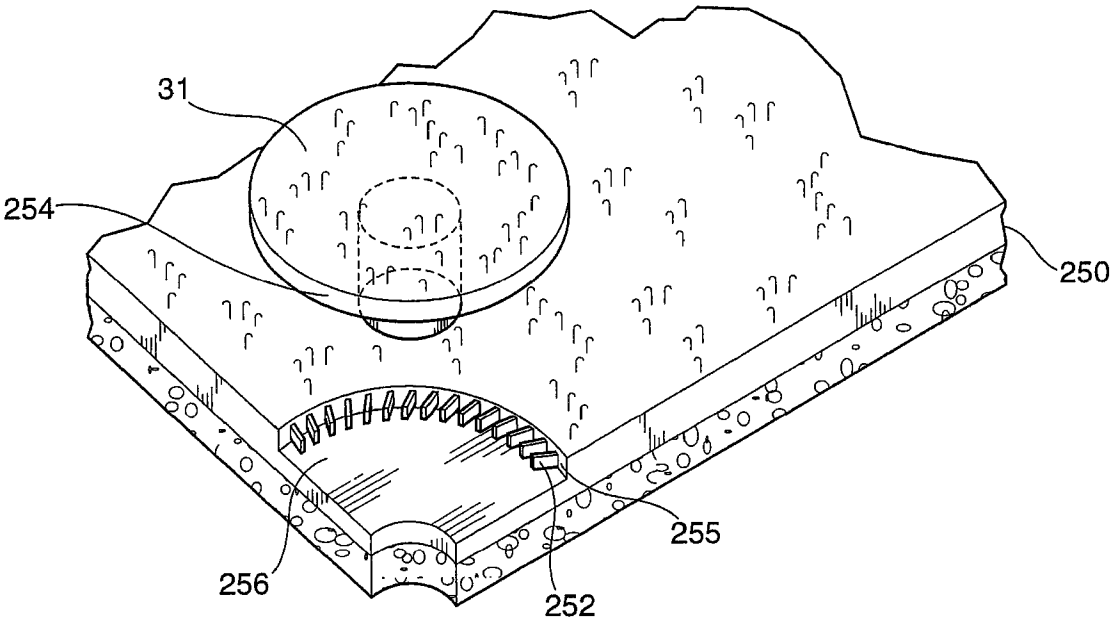
FIG. 13 shows an anchor sheet incorporating a spacing structure, with protrusions along its cutaway edge.

In FIG. 13, an improved anchor sheet incorporating a spacing structure 250 is the same as anchor sheet 1 from FIG. 2 with the addition of a plurality of protrusions 252, extending outwards from the edge 255 created by cut-away area 256 of improved anchor sheet 250. In one embodiment, protrusions 252 will be resilient, whereas in another embodiment protrusions 252 will be collapsible. In operation, attachment piece 31 is attached to the floor. Improved anchor sheets 250 are arranged around improved attachment piece 31, so that edge 254 of attachment piece 31 touches but does not deform protrusions 252. This will create a space to allow for expansion or contraction of improved anchor sheet 250, similar to space 117 in FIG. 4. This improvement will also operate with overlapping anchor sheets 111, as shown in FIGS. 3 and 4. The plurality of protrusions 252 constitute one type of deformable margin. A removable margin may also be used if it is located near the top of the anchor sheet.

Figure 14:
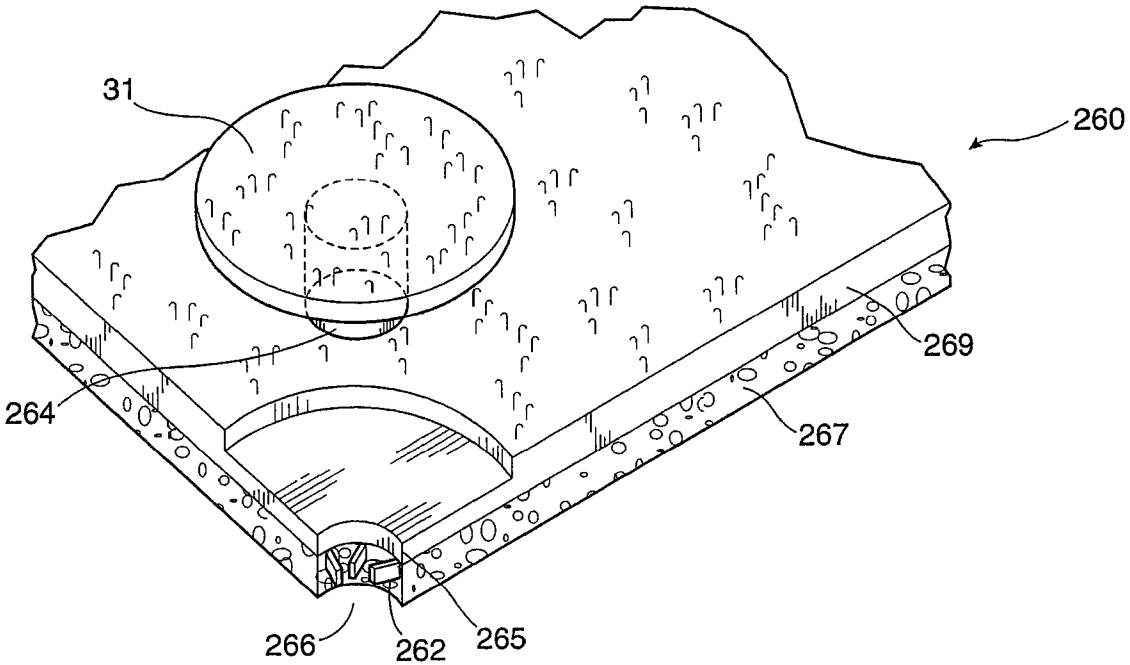
FIG. 14 shows an anchor sheet incorporating a spacing structure, with protrusions along its cutout edge.

In FIG. 14, improved anchor sheet incorporating a spacing structure 260 is the same as anchor sheet 1 from FIG. 2 with the addition of a plurality of protrusions 262, extending outwards from the edge 265 created by cut-out area 266 of anchor sheet 260. In one embodiment, protrusions 262 will be resilient, whereas in another embodiment protrusions 262 will be collapsible. Protrusions 262 are illustrated as extending from the layer of cushion material 267, but protrusions 262 could also extend from the sheet material 269. In operation, attachment piece 31 is attached to the floor. Improved anchor sheets 260 are arranged around attachment piece 31, so that edge 264 of attachment piece 31 touches but does not deform protrusions 252. This will create a space to allow for expansion or contraction of improved anchor sheet 260, similar to space 117 in FIG. 4. The plurality of protrusions 262 constitute one type of deformable margin.

Figure 15:
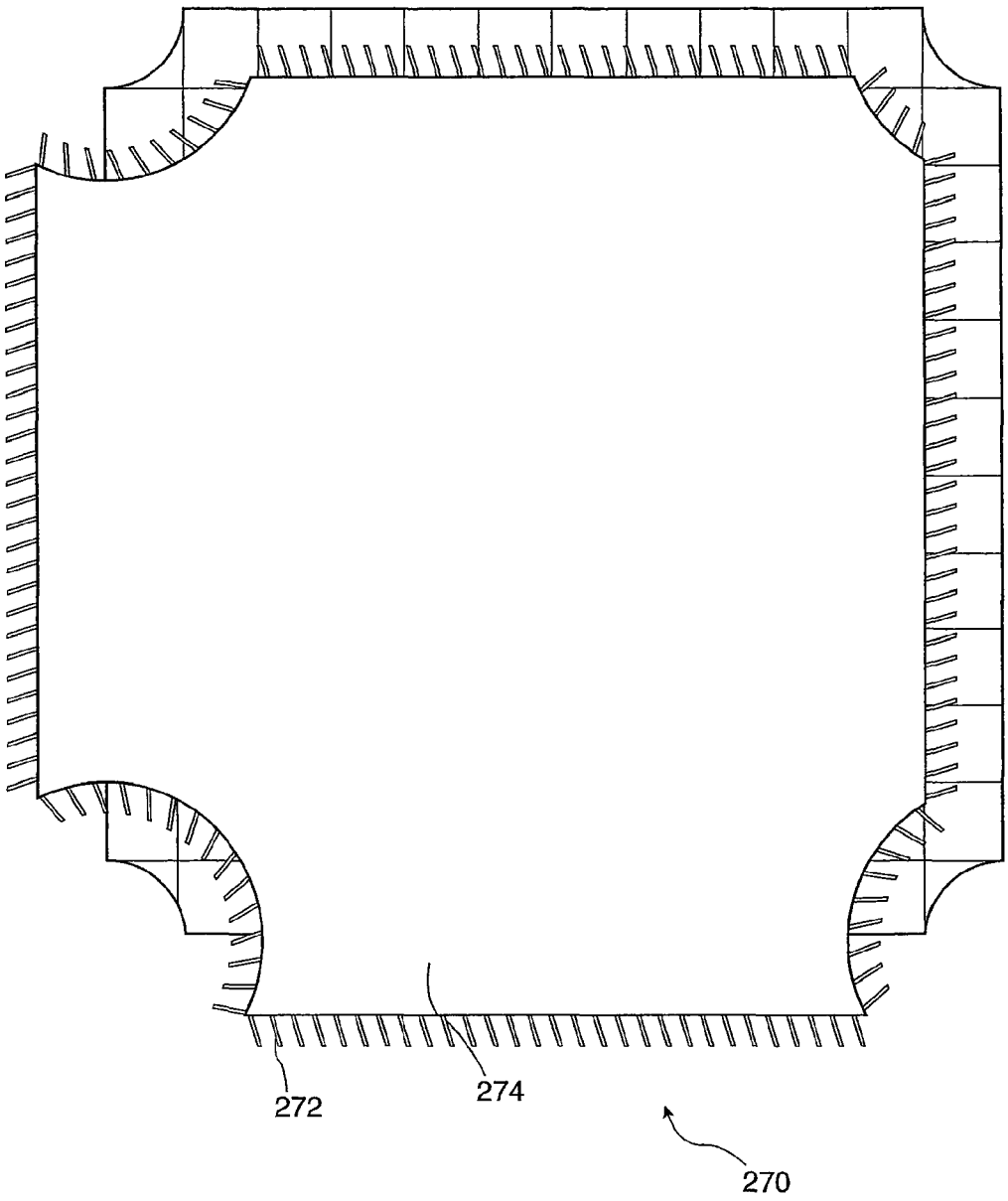
FIG. 15 shows an anchor sheet with overlap incorporating a spacing structure, with protrusions along its upper or overhang region.

A spacing structure may also be used on anchor sheets designed to overlap. Turning to FIG. 15, anchor sheet 270 is shaped similarly to the anchor sheets 111 of FIGS. 3 and 4. The underlay area is indicated by a grid pattern. A plurality of protrusions 272 extend outwardly from the upper or overhang region 274. The plurality of protrusions 272 is thus positioned to fend surrounding anchor sheets or attachment pieces. In one embodiment, protrusions 272 will be resilient, whereas in another embodiment protrusions 272 will be collapsible. Protrusions 272 need not surround the entire edge of upper or overhang region 274, but can only be installed in certain portions of upper or overhang region 274. In operation, an attachment piece is attached to the floor. Improved anchor sheets 270 are arranged around the attachment piece, so that the attachment piece and surrounding anchor sheets touch but do not deform protrusions 272. This will create a space to allow for expansion or contraction of improved anchor sheet 270, similar to space 117 in FIG. 4. The plurality of protrusions 272 constitute one type of deformable margin. A removable margin may also be used if it is located near the top of the anchor sheet.

Figure 16:
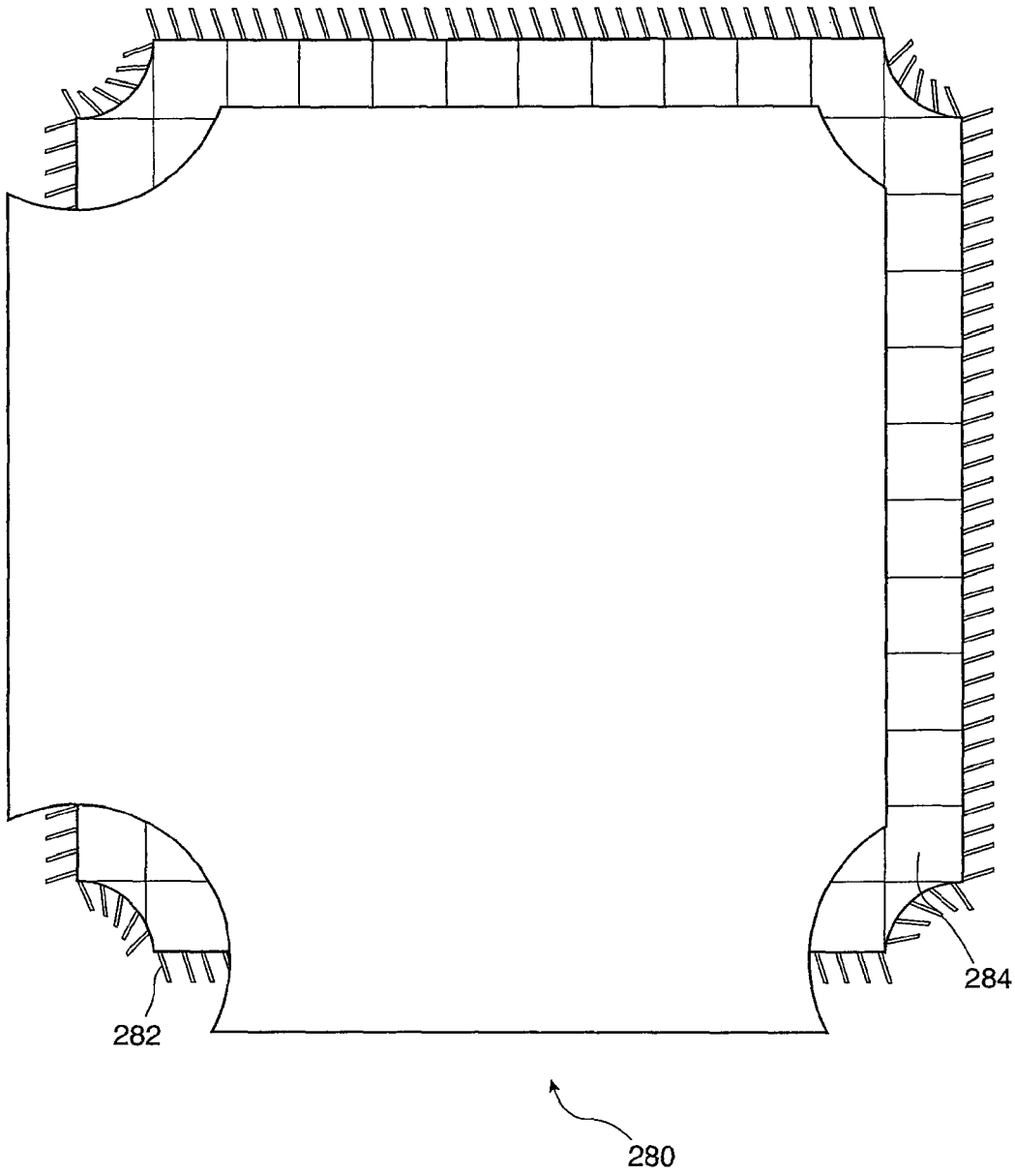
FIG. 16 shows an anchor sheet with overlap incorporating a spacing structure, with protrusions along its lower or underlap region.

Turning to FIG. 16, anchor sheet 280 is shaped similarly to the anchor sheets 111 of FIGS. 3 and 4. The lower, underhang or underlay area 284 is indicated by a grid pattern. A plurality of protrusions 282 extend outwardly from the lower or underhang region 284. The plurality of protrusions 282 is thus positioned to fend surrounding anchor sheets or attachment pieces. In one embodiment, protrusions 282 will be resilient, whereas in another embodiment protrusions 282 will be collapsible. Protrusions 282 need not surround the entire edge of lower or underhang region 284, but can only be installed in certain portions of lower or underhang region 284. In operation, an attachment piece is attached to the floor. Improved anchor sheets 280 are arranged around the attachment piece, so that the attachment piece and surrounding anchor sheets touch but do not deform protrusions 282. This will create a space to allow for expansion or contraction of improved anchor sheet 280, similar to space 117 in FIG. 4. The plurality of protrusions 282 constitute one type of deformable margin.

Figure 17B:
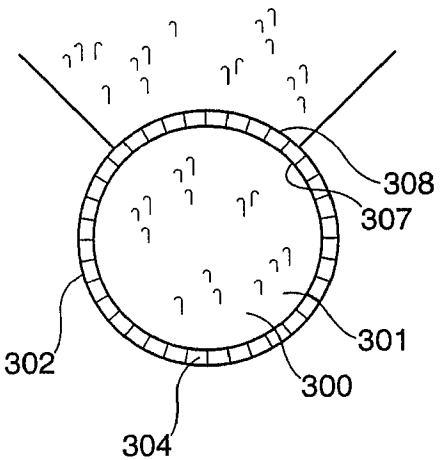
FIG. 17*b* is a plan view of the attachment piece of FIG. 17*a* with the anchor sheet of FIG. 1.
Figure 17A:
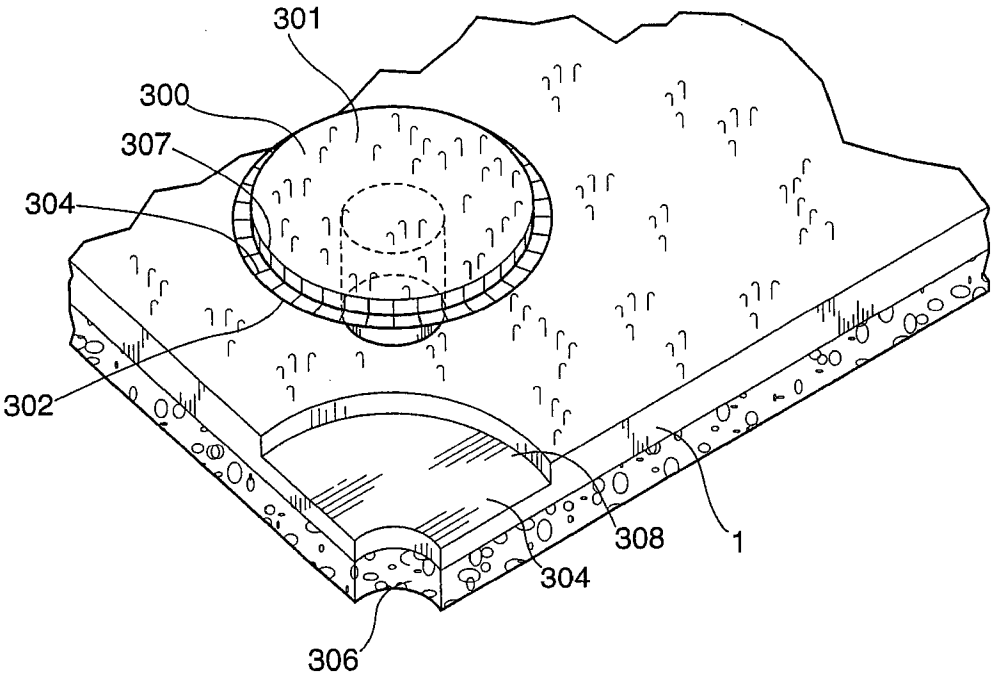
FIG. 17*a* shows an attachment piece with a deformable ring and spoke spacing structure which could be used with the anchor sheet of FIG. 1.

It should be noted that the spacing to be created between adjacent anchor sheets and attachment pieces is a space between the relatively rigid parts of the attachment sheets and attachment pieces. In some embodiments, this space may be entirely filled by the deformable margin. For example, in FIG. 17*a*, an anchor sheet 1 is shown with an attachment piece 300 with a rigid upper disk 301. A spacing structure is attached to attachment piece 300 consisting of a deformable ring 302 connected to a plurality of deformable spokes 304. Deformable ring 302 thus creates a deformable margin around the relatively rigid central disk 301 of attachment piece 300. FIG. 17*b* shows a plan view of attachment piece inserted into the space created by cut-away region 304 and cut-out region 306 in FIG. 17*a*. Note that deformable ring 302 lies flush with anchor sheet 1. The required space is created between edge 307 of rigid disk 301 and edge 308 of cut-away region 304. This space is entirely filled with deformable ring 302 and spokes 304.

Figure 18B:
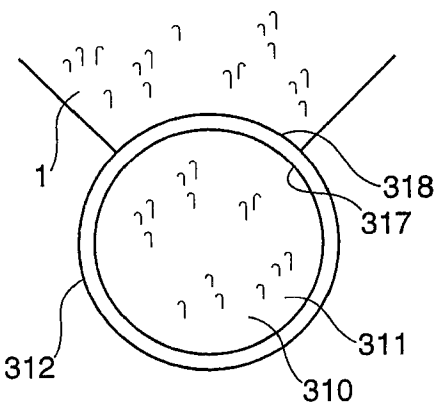
FIG. 18*b* is a plan view of the attachment piece of FIG. 18*a* with the anchor sheet of FIG. 1.
Figure 18A:
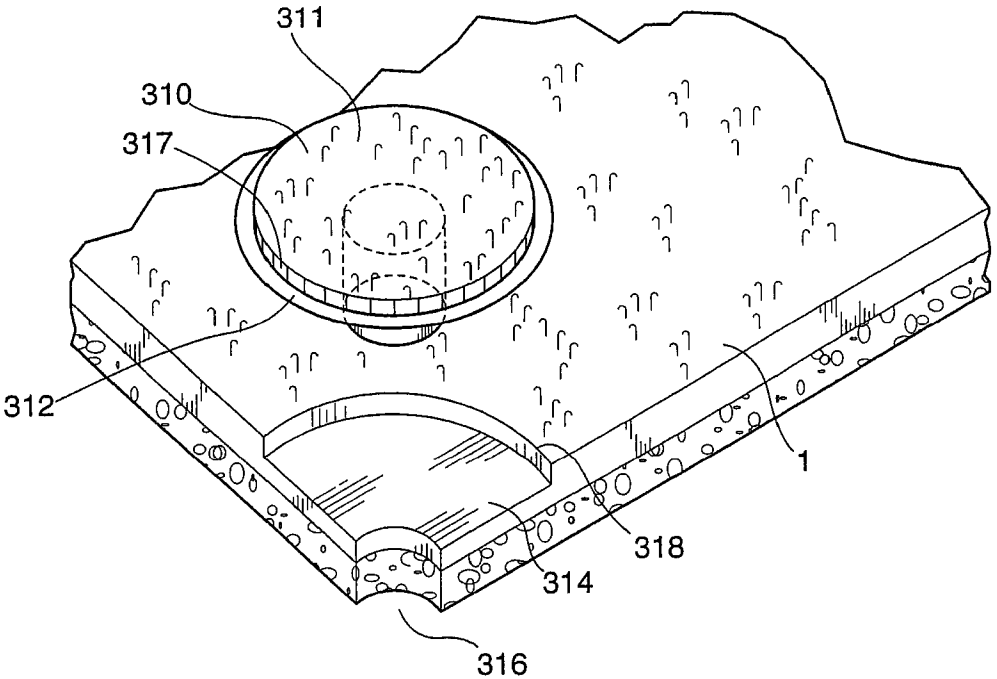
FIG. 18*a* shows an attachment piece with a deformable o-ring spacing structure which could be used with the anchor sheet of FIG. 1.

A second similar embodiment may be seen in FIGS. 18*a* and 18*b*. Turning to FIG. 18*a*, an anchor sheet 1 is shown with an attachment piece 310 with a rigid upper disk 311. A spacing structure is attached to attachment piece 310 consisting of a deformable o-ring 312. Deformable o-ring 312 thus creates a deformable margin around the relatively rigid central disk 311 of attachment piece 310. FIG. 18*b* shows a plan view of attachment piece inserted into the space created by cut-away region 314 and cut-out region 316 in FIG. 17*a*. Note that deformable o-ring 312 lies flush with anchor sheet 1. The required space is created between edge 317 of rigid disk 311 and edge 318 of cut-away region 314. This space is entirely filled with deformable o-ring 312.

In a further alternative embodiment, a deformable margin of a type pictured in FIG. 17*a*, 17*b*, 18*a* or 18*b* is attached to either or both of the anchor sheets or attachment pieces.

It is noted that those skilled in the art will appreciate that various modifications of detail may be made from the embodiments described herein which would come within the spirit and scope of the invention as described in the following claims.

I claim:

1. An anchor sheet comprising:

a sheet with a first surface and a second surface;

the sheet being made of one of a polypropylene and a polyethylene, and a cushion layer attached to the second surface, the cushion layer being entirely free of attachment means to permit the anchor sheet to free float over a substrate;

wherein the first surface bears a field of hooks, the hooks having a density between 160 hooks per square inch to 1200 hooks per square inch, and wherein the sheet is injection molded.

2. The anchor sheet of claim 1, wherein the field of hooks has a density of approximately 330 hooks per square inch.

3. The anchor sheet of claim 1, wherein the anchor sheet is a square in the range of approximately 12 inch by 12 inch to approximately 36 inch by 36 inch.

4. The anchor sheet of claim 3, wherein the cushion resilient layer has a thickness between ¼of an inch and ⅜of an inch.

5. The anchor sheet of claim 4, wherein the sheet has a thickness between 0.020 inches and 0.75 inches.

6. The anchor sheet of claim 5, wherein the sheet has a thickness between 0.062 inches and 0.75 inches.

7. The anchor sheet of claim 6 wherein the sheet is 0.125 inches thick.

8. An anchor sheet for attachment to a floor covering to form a finished decorative surface, the floor covering having a side covered in loops, the anchor sheet comprising:

(a) an injection-molded plastic sheet having a first surface and a second surface, the sheet having a thickness of between 0.020 inches and 0.75 inches; and (b) hooks covering a the first side of the plastic sheet for engaging loops of the floor covering, the hooks having a density of between 160 to 1200 hooks per square inch, and wherein the second surface is entirely free of attachment means to a supporting substrate.

9. The anchor sheet of claim 8 wherein in the hooks have a density of about 330 hooks per square inch.

10. The anchor sheet of claim 8 wherein the plastic is at least one of polyethylene and polypropylene.

11. The anchor sheet of claim 8, wherein the sheet has a thickness of about ⅛ inches.

12. The anchor sheet of claim 8, wherein the hooks are integrally molded with the anchor sheet.

13. The anchor sheet of claim 8, further comprising a resilient layer.

14. The anchor sheet of claim 8, wherein the anchor sheet is approximately 24 inches by 24 inches.

15. The anchor sheet of claim 8 in which the anchor sheet provides a countersunk area.

* * * * *